US011453841B2

(12) United States Patent
Mabon et al.

(10) Patent No.: US 11,453,841 B2
(45) Date of Patent: Sep. 27, 2022

(54) FUNCTIONALIZED BRANCHED ALCOHOLS AS NON-IONIC SUGAR SURFACTANTS

(71) Applicant: ExxonMobil Technology and Engineering Company, Annandale, NJ (US)

(72) Inventors: Ross Mabon, Whitehall, PA (US); Shane Deighton, Bound Brook, NJ (US); Arben Jusufi, Belle Mead, NJ (US)

(73) Assignee: EXXONMOBIL TECHNOLOGY AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 17/124,960

(22) Filed: Dec. 17, 2020

(65) Prior Publication Data

US 2021/0189289 A1 Jun. 24, 2021

Related U.S. Application Data

(60) Provisional application No. 62/950,433, filed on Dec. 19, 2019.

(51) Int. Cl.

| | |
|---|---|
| ***C11D 1/722*** | (2006.01) |
| ***C11D 3/22*** | (2006.01) |
| ***C11D 1/66*** | (2006.01) |
| ***C11D 3/43*** | (2006.01) |

(52) U.S. Cl.

CPC ..... *C11D 1/662* (2013.01); *C11D 1/722* (2013.01); *C11D 3/43* (2013.01)

(58) Field of Classification Search

CPC ..... C11D 1/662; C11D 1/721; C11D 1/722; C11D 3/22; C11D 3/222; C11D 3/225

See application file for complete search history.

(56) References Cited

U.S. PATENT DOCUMENTS 5,644,041 A 7/1997 Johansson

FOREIGN PATENT DOCUMENTS

KR 20180002292 * 1/2018 ..... C07H 15/04

OTHER PUBLICATIONS

Jackson E. Moore, "Wormlike micelle formation of novel alkyl-tri(ethylene glycol)-glucoside carbohydrate surfactants: Structure-function relationships and rheology", Journal of Colloid and Interface Science, 2018, vol. 529, pp. 464-475, Australia.

* cited by examiner

*Primary Examiner* — Brian P Mruk

(74) *Attorney, Agent, or Firm* — Kristina Okafor

(57) ABSTRACT

Provided herein are functionalized branched alcohols comprising a glycosyl group, an ethylene oxide linker and a tail. The ethylene oxide linker comprises one or more units of ethylene oxide. The glycosyl group is a substituent structure of a cyclic monosaccharide. The tail comprises a branched paraffin or isomers thereof, the glycosyl group is attached to the ethylene oxide linker, and the ethylene oxide linker is attached to the tail. In an aspect, the glycosyl group is a substituent structure of glucose, mannose, galactose, sorbose, fructose, xylose, arabinose, ribose, lyxose, lactose, or maltose, or variants thereof. The tail can be a paraffin comprising 9 to 13 carbon atoms.

12 Claims, 8 Drawing Sheets

FUNCTIONALIZED BRANCHED ALCOHOLS AS NON-IONIC SUGAR SURFACTANTS

The instant application claims benefit of Provisional Ser. No. 62/950,433 filed on Dec. 19, 2019.

FIELD OF THE INVENTION

The present invention relates to branched alcohols, and more specifically relates to functionalized branched alcohols useful as non-ionic sugar surfactants.

BACKGROUND OF THE INVENTION

Surfactant molecules are amphiphilic compounds, that is, some portion of the molecule is hydrophilic and some portion of the molecule is hydrophobic. These two segments have different solubility behavior in oil and water. At an oil-water interface, the polar segment of the molecule is found in the water phase while the non-polar segment resides in the oil phase. Surfactants can be classified based on polarity where an ionic surfactant interacts with polar fluids through charge-based interactions, or as a non-ionic surfactant that interacts through non-charged-based interactions such as hydrogen bonding. Traditional building blocks of surfactants include linear alpha olefins, linear alcohols, and linear alkyl benzenes, which are converted to surfactants through sulfonation, and/or ethoxylation.

EXXAL™ branched alcohols are used to make a wide range of regulatory compliant biodegradable non-ionic surfactants or ethoxylates (also referred to herein as "branched ethoxylates"). The EXXAL™ branched alcohols help fulfill a demand for biodegradable surfactants that meet regulatory and voluntary standards without compromising on the quality of the formulation. More specifically, EXXAL™ branched alcohol ethoxylates provide the advantages of effectiveness, dynamic surface tension, rate of wetting, gel phase formation, foaming and low pour points. For example, EXXAL™ branched ethoxylates can provide lower minimum surface tension values, but higher critical micelle concentrations ("CMC") than the linear equivalents.

In addition, EXXAL™ branched ethoxylates often require less time to reach the desired surface tension than linear based ethoxylates. Furthermore, EXXAL™ branched ethoxylates when used in industrial surfactants have been shown to have a reduced wetting time from 12 to 4 seconds: 3 times lower than comparable linear alcohol ethoxylates, resulting in lower processing times in applications like fast textile processing. The rate of wetting can impact process efficiencies, both in speed and evenness of application. Similarly, wetting performance leads to advantages in crop applications when active ingredients need to be quickly applied on surfaces.

Moreover, because gel phases can make product handling more difficult, gel phases are generally avoided in industrial applications. EXXAL™ branched ethoxylates can form fewer gel phases in water solutions than linear alcohols of comparable molecular weight. Due to this, solutions using EXXAL™-based ethoxylates remain fluid, providing a performance advantage for formulators or end users by improving product handling ability.

Despite these advantages, the surfactant industry faces the continued challenge of delivering an ever-increasing supply of biodegradable products that meet these performance requirements. As many in the industry maintain that there is a trade-off between biodegradability and performance, a need exists, therefore, for new branched alcohols that have increased biodegradability performance in terms of rates while maintaining the same advantages of the existing EXXAL™ branched alcohols and branched ethoxylates.

SUMMARY OF THE INVENTION

Provided herein are functionalized branched alcohols comprising a glycosyl group, an ethylene oxide linker and a tail. The ethylene oxide linker comprises one or more units of ethylene oxide. The glycosyl group is a substituent structure of a cyclic monosaccharide. The tail comprises a branched paraffin or isomers thereof, the glycosyl group is attached to the ethylene oxide linker, and the ethylene oxide linker is attached to the tail. In an aspect, the glycosyl group is a substituent structure of glucose, mannose, galactose, sorbose, fructose, xylose, arabinose, ribose, lyxose, lactose, or maltose, or a variant thereof. In an aspect, the number of units of ethylene oxide is 3. The tail comprises 9 to 15 carbon atoms and, in an aspect, 9 to 13 carbon atoms. In an aspect, the present functionalized branched alcohols are soluble in water without addition of solubilizers.

Further provided are compounds of the structural formula:

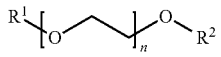

wherein n is an integer from 1 to 3, $R^1$ is a branched paraffin, and $R^2$ is a glycosyl group. Also provided are mixtures of a plurality of compounds having the same structural formula shown immediately above. In an aspect, the mixtures of compounds can comprise isomers of one or more of the plurality of compounds. In an aspect, n is an integer from 3 to 7 and the amount of the plurality of compounds in the mixture is at least 70 wt.%. In an aspect, the mixture further comprises isomers of one or more of the plurality of compounds. In an aspect, the mixture has a carbon distribution number between about 10 and about 13. In an aspect, the glycosyl group is a substituent structure of glucose, mannose, galactose, sorbose, fructose, xylose, arabinose, ribose, lyxose, lactose, or maltose, or variants thereof. In an aspect, the glycosyl group is a substituent structure of glucose. In an aspect, the compound is readily biodegradable in accordance with OECD 301 F.

Moreover, provided herein are methods of making functionalized branched alcohols comprising the steps of: (a) providing branched ethoxylates; (b) reacting the branched ethoxylates with protected monosaccharides in the presence of an acid catalyst wherein the protected monosaccharides comprise a monosaccharide and a protecting group; and (c) removing the protecting group with a base to provide the functionalized branched alcohols.

Further provided herein are methods of making functionalized branched alcohols comprising the steps of: (a) providing extended branched alcohols; (b) converting the extended branched alcohols to tosylates; (c) converting the tosylates to extended branched ethoxylates; (d) reacting the extended branched ethoxylates with protected monosaccharides in the presence of an acid catalyst, the protected monosaccharides comprising a monosaccharide and a protecting group; and (e) removing the protecting group with a base to provide the functionalized branched alcohols.

Further provided herein are methods of making functionalized branched alcohols comprising the steps of: (a) removing hydrogen from branched alcohols by hydrogen abstraction to form aldehydes, wherein the aldehydes undergo in situ conversion into alkenes which are then hydrogenated to produce extended branched esters; (b) reducing the extended branched esters to produce the extended branched alcohols; (c) converting the extended branched alcohols to tosylates; (d) converting the tosylates to extended branched ethoxylates; (e) reacting the extended branched ethoxylates with protected monosaccharides in the presence of an acid catalyst, the protected monosaccharides comprising a monosaccharide and a protecting group; and (f) removing the protecting group with a base to provide the functionalized branched alcohols.

In an aspect, the extended branched alcohols are converted to tosylates by activation of alcohol substituents of extended branched alcohols by tosylation or substitution of halogenation. In an aspect, the tosylates are converted to extended branched ethoxylates by reaction with alkylene glycol or polyalkylene glycol. In an aspect, the acid catalyst is a Lewis Acid. In an aspect, the functionalized branched alcohols are soluble in water without addition of solubilizers. Further provided herein are non-ionic surfactants comprising the functionalized branched alcohols.

BRIEF DESCRIPTION OF THE DRAWINGS

FIG. 3A is a dynamic surface tension plot showing surface tension versus surface age of the alkyl-tri(ethylene glycol)-glucoside carbohydrate surfactants. FIG. 3B is a critical micelle concentration ("CMC") plot showing equilibrium surface tension versus concentration with two linear fits of pre- and post-CMC data. FIG. 3C is a plot of CMC versus number of carbons in surfactant tail-group with exponential fit.

DETAILED DESCRIPTION OF THE INVENTION

Figure 1:
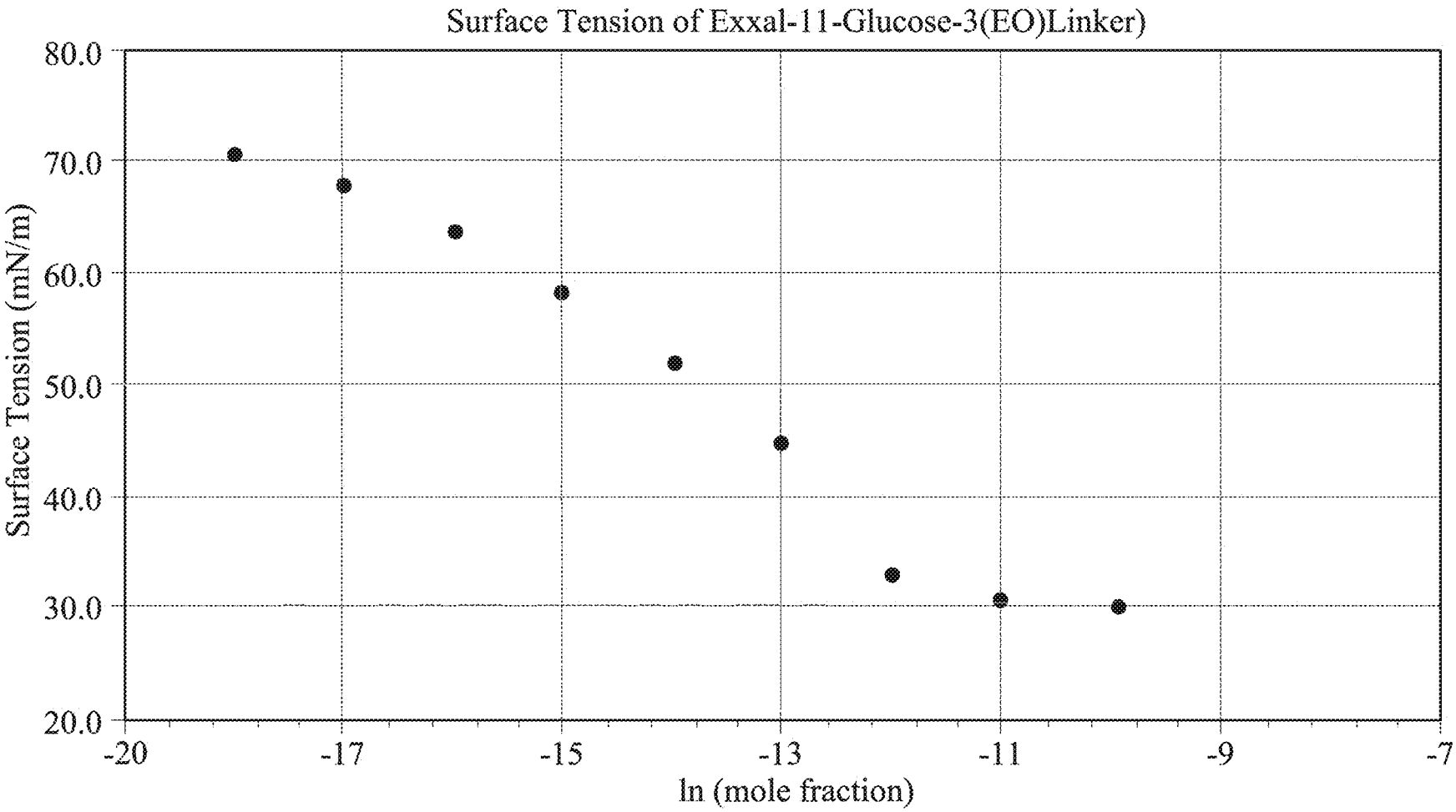
FIG. 1 is a plot of surface tension of the functionalized branched alcohols, referred to herein as EXXAL™ 11-Glucose-3(EO)Linker or EXXAL™ 11-EO3-Glucoside, both "3(EO)" and "E03" indicate 3 ethylene oxide units.

Before the present compounds, components, compositions, and/or methods are disclosed and described, it is to be understood that unless otherwise indicated this disclosure is not limited to specific compounds, components, compositions, reactants, reaction conditions, ligands, catalyst structures, or the like, as such can vary, unless otherwise specified. It is also to be understood that the terminology used herein is for the purpose of describing particular embodiments only and is not intended to be limiting.

All numerical values within the detailed description and the claims herein are modified by "about" or "approximately" the indicated value, taking into account experimental error and variations.

For the sake of brevity, only certain ranges are explicitly disclosed herein. However, ranges from any lower limit can be combined with any upper limit to recite a range not explicitly recited, as well as, ranges from any lower limit can be combined with any other lower limit to recite a range not explicitly recited, in the same way, ranges from any upper limit can be combined with any other upper limit to recite a range not explicitly recited. Additionally, within a range includes every point or individual value between its end points even though not explicitly recited. Thus, every point or individual value can serve as its own lower or upper limit combined with any other point or individual value or any other lower or upper limit, to recite a range not explicitly recited.

For the purposes of this disclosure, the following definitions will apply:

As used herein, the terms "a" and "the" as used herein are understood to encompass the plural as well as the singular.

The term, "α carbon" refers to a carbon atom adjacent to a functional group in a functionalized hydrocarbon. In alcohols, the a carbon is the carbon atom adjacent to the alcohol group.

The term "biodegradability" refers to a substance's ability to be consumed aerobically by microorganisms. Biodegradability is expressed as a percent degradation during a specified time and is determined according to OECD 301 F. A substance is "readily biodegradable" if it reaches greater than 60% degradation in 28 days.

The term "cloud point" refers to the temperature at which a multi-phase solution containing a surfactant begins to cloud. Cloud point is measured according to ASTM D2024.

The term "critical micelle concentration" or "CMC" refers to the concentration of surfactant at which micelles form and all additional surfactant added to the system goes to micelles.

The term "dynamic surface tension" refers to a rate at which equilibrium surface tension is reached. Dynamic surface tension is expressed as the time required to reach equilibrium surface tension for a fixed surfactant concentration in water at 20° C. Dynamic surface tension is measured by maximum bubble pressure.

The term "esterification" refers to a reaction of a carboxylic acid moiety with an organic alcohol moiety to form an ester linkage. Esterification conditions can include, but are not limited to, temperatures of 0-300° C., and the presence or absence of homogeneous or heterogeneous esterification catalysts such as Lewis or Brønsted acid catalysts.

The term "hydroformylation" refers to an industrial process for the production of aldehydes from alkenes where the chemical reaction results in an addition of a formyl group (CHO) and a hydrogen atom to a carbon-carbon double bond. Hydroformylation is also known as an oxo synthesis or oxo process.

The term "hydrogenation" refers to a chemical reaction between molecular hydrogen ($H_2$) and a compound in the presence of a catalyst to reduce or saturate the compound.

The term "hydrophilic lipophilic balance" ("HLB") refers to a measure of the degree to which a surfactant is hydrophilic or lipophilic as determined on a 20-point scale. Higher HLB values indicate that the surfactant has increased hydrophilicity and water solubility. Conversely, lower values of HLB indicate the surfactant is hydrophobic and has lower water solubility. HLB can be determined by the Griffin method or the Davies method.

The term "Krafft point" refers to the minimum temperature to form micelles. Krafft point can be measured according to ASTM D2024.

The term "pour point" refers to the temperature below which the liquid loses its flow characteristics. Pour point is measured according to ASTM D5950.

The phrase "rate of wetting" refers to the time required to wet a standard cotton skein by a 1g/L surfactant solution. Rate of wetting is measured according to the Draves test.

As described herein, surfactants are added in small amounts to a fluid because this small amount has a profound effect on the surface and interfacial properties of the fluid. Surface tension or interfacial tension ("IFT"), is a frequently used value, often reported as force/distance (i.e. N/m) that corresponds to a unit of energy per unit area. The IFT, the free energy required to create more interfaces, is reduced when a surfactant is present.

Another important requirement of the surfactant is water solubility. Attaching weak hydrophilic groups can reduce solubility and increase the Krafft point. Solubilizers are sometimes added to mitigate solubility problems of some surfactants. Surfactants which do not require further solubilizing agents in the formulation are desirable. Moreover, in addition to water solubility and surfactant efficiency, commercial surfactants are classified on the basis of biodegradability, particularly for household and "green" applications.

ExxonMobil Chemicals Company currently sells alcohol mixtures for surfactant applications through EXXAL™ products, particularly EXXAL™ 11 and EXXAL™ 13. It is anticipated that the demand for surfactants comprising alpha olefins and lightly branched olefins will continue to increase. Therefore, as described herein, functionalization of these alcohols can help meet the demand of the ever-increasing surfactant market.

To generate non-ionic surfactants, the hydrophobic alcohols have been attached to hydrophilic counterparts of ethylene oxide units as shown in Formula I below:

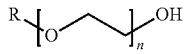

(I)

where n can be 1 to 3. For example, Imbentin U070, an EXXAL™ 11 based compound, comprises seven (7) ethylene oxide groups in a hydrophilic segment making this compound water soluble and surface active.

As provided herein, we have shown that similar performance in water solubility as well as surface activity can be achieved by functionalizing EXXAL™ 11 with only 3 EO groups and by terminating the alcohols with a glucose, mannose, galactose, sorbose, fructose, xylose, arabinose, ribose, lyxose, lactose, or maltose, or variants thereof. Although this approach has been used in a single-component model system, for the first time, we have demonstrated that this approach is applicable for complex mixtures such as EXXAL™ 11 that can contain thousands of components. Importantly, because glucose and other sugar molecules are highly biodegradable, improvements in biodegradability rates for functionalized EXXAL™0 products are anticipated to be superior to commercial counterparts such as Imbentin U070.

Therefore, the present disclosure is directed to new methods and compounds, including mixtures of compounds, of functionalized branched alcohols, such as those derived from EXXAL™ branched alcohols or extended branched alcohols, which can function as biodegradable non-ionic surfactants.

Methods of making functionalized branched alcohols include the steps of modifying the branched ethoxylates or extended branched ethoxylates to produce functionalized branched alcohols. By reacting the branched ethoxylates in the presence of an acid catalyst, a substituent structure of a monosaccharide is attached to the branched alcohols having an ethylene oxide linker that increases water solubility of the branched alcohols and can diminish the need for adding solubilizers.

ExxonMobil Chemical Company ("EMCC") produces oxo alcohols, including EXXAL™ branched alcohols, that can serve as intermediates for a wide range of applications, including the preparation of surfactants based on glycosides, ethoxylates, sulfonates, and similar derivatizations to improve water solubility.

Similarly, hydrophilic modifications to complex alcohol mixtures such as EXXAL™ 11 can increase water solubility. For example, Imbentin U070, an EXXAL™ 11 based compound, has seven (7) EO groups in its hydrophilic segment. While increasing the number of units of EO groups can increase the water solubility of the non-ionic surfactant, large numbers of EO groups can negatively impact overall surfactant effectiveness. M. J. Rosen, *Surfactants and Interfacial Phenomena,* 3rd ed., John Wiley & Sons, 2004.

Provided herein are functionalized branched alcohols comprising a glycosyl group, an ethylene oxide linker and a tail where surfactant efficiency is increased, and additional solubilizing agents are not required. In the present functionalized branched alcohols, the ethylene oxide linker comprises one or more units of ethylene oxide. The glycosyl group is a substituent structure of a cyclic monosaccharide. The tail comprises a branched paraffin or isomers thereof, the glycosyl group is attached to the ethylene oxide linker, and the ethylene oxide linker is attached to the tail. In an aspect, the tail can comprise a branched olefin. Since olefins exhibit similar hydrophobicity to paraffins, the surface activity of functionalized branched alcohols comprising a tail comprising a branched olefin is expected to be similar to the surface activity of functionalized branched alcohols comprising a tail comprising a branched paraffin. The glycosyl group is a substituent structure of glucose, mannose, galactose, sorbose, fructose, xylose, arabinose, ribose, lyxose, lactose, or maltose, or variants thereof.

Functionalized branched alcohols are prepared by modifying the branched alcohols with an ethylene oxide linker and a glycosyl group as shown in Formula II below.

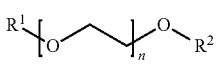

(II)

where $R^1$ is a branched paraffin, n is an integer between 1 to 3 and $R^2$ is a glycosyl group that imparts solubility characteristics comparable to larger molecular weight groups, such as extended polyethylene glycols, while maintaining similar or improved surface activity. $R^1$ can have 9 to 13 carbon atoms, or in an aspect can have 9 to 15 carbon atoms.

Commercially Available EXXAL™ Branched Alcohols

Commercially available EXXAL™ branched alcohols are mixtures of long-chain, primary aliphatic branched alcohols, secondary aliphatic branched alcohols and isomers thereof. For example, EXXAL™ 11 includes $C_{10}$, $C_{11}$, and $C_{12}$ hydrocarbons, has about 87 wt % of $C_{11}$ hydrocarbons and has an average branching number of about 2.20. Tables 1A and 1B immediately below provide carbon number distributions and average branching of several EXXAL™ branched alcohols.

TABLE 1A

| | Average Carbon Number Distribution by GC (wt %) | | | | | | | | | Average Branching #branches/ |
|---|---|---|---|---|---|---|---|---|---|---|
| | $C_6$ | $C_7$ | $C_8$ | $C_9$ | $C_{10}$ | $C_{11}$ | $C_{12}$ | $C_{13}$ | $C_{14}$ | molecule |
| EXXAL ™ 8 | <0.1 | 1.8 | 92.7 | 5.2 | 0.2 | | | | | 1.61 |
| EXXAL ™ 9 | | | 3 | 77.1 | 18.8 | 1.1 | | | | 1.87 |
| EXXAL ™ 10 | | | 0.1 | 6.4 | 88.2 | 5.2 | | | | 2.06 |
| EXXAL ™ 11 | | | | | 6.7 | 87 | 6.3 | | | 2.20 |
| EXXAL ™ 13 | | | | 0.17 | 0.3 | 1.4 | 21.5 | 70.1 | 6.7 | 3.07 |

TABLE 1B

| | Spec Limits Max (wt %) | | |
|---|---|---|---|
| EXXAL ™ 8 | $C_6 + C_{10}^+$ 2.0 | $C_7$ 3.5 | $C_9$ 2.0-9.0 |
| EXXAL ™ 9 | $C_8$ 6.0 | $C_{10}$ 18-22 | $C_{11}^+$ 2.5 |
| EXXAL ™ 10 | $C_8$ 0.75 | $C_9$ 10.0 | $C_{11}^+$ 7.0 |
| EXXAL ™ 11 | $C_{10}^-$ 6.7 | $C_{11}$ 87.0 | $C_{12}^+$ 6.3 |
| EXXAL ™ 13 | $C_9 + C_{10}$ 2.0 | $C_{14}^+$ 10.0 | |

In addition to the data presented above, other characteristics were determined for the EXXAL™ branched alcohols shown in Tables 1A and 1B. The percentage α branching is estimated to be between about 10% and about 15% for each of the EXXAL™ branched alcohol mixtures. The percentage of quaternary carbons is estimated to be between about 1% and about 2% for each of the EXXAL™ branched alcohols. Furthermore, EXXAL™ 13 can have an average carbon number between about 12.6 and about 12.7, an average number of branches per molecules between about 2.90 and about 3.07 and can comprise between about 60 wt % $C_{13}$ and about 70.1 wt % $C_{13}$. See U.S. Patent Appl. Nos. 2011/0313090 Table 1 and 2011/0184105 Table 1, incorporated herein by reference.

Objective criteria and recognized test methods show that EXXAL™ branched alcohols and ethoxylates readily biodegrade. The test methods include EPA- and EU-approved tests such as an OECD 301F manometric respirometry test that assesses "ultimate" biodegradation, or breakdown of the substance by microorganisms, resulting in the production of carbon dioxide, water, mineral salts and new biomass. The criterion to "pass" as readily biodegradable in OECD 301F test is to reach 60% degradation in 28 days (for constituent substances it is the same within a "10-day window"). EXXAL™ branched alcohols and the ethoxylates meet the OECD readily biodegradable threshold for isomeric mixtures. Specifically, both EXXAL™ 11 and EXXAL™ 13 are readily biodegradable: EXXAL™ 11 demonstrated 71% degradation in 28 days and EXXAL™ 13 demonstrated 61% degradation in 28 days, both measured according to OECD 301 F.

EXXAL™ branched alcohol mixtures contain isomers having different branching structures. As to linear chains, EXXAL™ branched alcohols' purity exceeds 99%, High-purity EXXAL™ branched alcohols exhibit reactivity typical of higher primary alcohols. Having a branched structure, EXXAL™ branched alcohols are characterized by low pour points. While linear $C_{12}$-$C_{14}$ alcohols have pour points around room temperature (20° C.), branched alcohols such as EXXAL™ 13 have pour points lower than −40° C. Lower pour points have the advantage of reducing the need for heated tanks and lines for operations in colder climates, which in turn can lower energy bills and reduce handling costs.

Table 2 immediately below provides additional physical properties of EXXAL™ branched alcohols.

TABLE 2

| | EXXAL ™ 8 | EXXAL ™ 9 | EXXAL ™ 10 | EXXAL ™ 11 | EXXAL ™ 13 |
|---|---|---|---|---|---|
| Chemical Name | Isooctanol | Isononanol | Isodecanol | Isoundecanol | Isotridecanol |
| Acid Value Mg KOH/g ASTM D1045 | <0.05 | <0.05 | <0.05 | <0.10 | <0.03 |
| Boiling Range ° C. ASTM D1078 | 186-192 | 204-214 | 218-224 | 233-239 | 255-263 |
| Carbonyl Number Mg KOH/g ISO 1843-1 ASTM E411 | <0.20 | <0.20 | <0.20 | <0.20 | <0.20 |
| Color Pt/Co ASTM D5386 | 5 | 5 | 5 | 5 | 5 |

TABLE 2-continued

| | EXXAL ™ 8 | EXXAL ™ 9 | EXXAL ™ 10 | EXXAL ™ 11 | EXXAL ™ 13 |
|---|---|---|---|---|---|
| Density 20° C. g/cm$^3$ ASTM D4052 | 0.831 | 0.835 | 0.838 | 0.841 | 0.846 |
| Flash Pt. PMCC ° C. ASTM D93 | >70 | >80 | >90 | >100 | >100 |
| Hydroxyl Number Mg KOH/g ISO 1843-5 | 425 | 377 | 350 | 321 | 285 |
| Pour Pt. ° C. ASTM D5950 | <−40 | <−40 | <−40 | <−40 | <−40 |
| Viscosity at 20° C. Mm$^2$/s ASTM D445 | 12 | 17 | 21 | 27 | 48 |
| Water content Wt % ISO 12937 | <0.1 | <0.1 | <0.1 | <0.1 | <0.1 |

Furthermore, EXXAL™ 13 can have a boiling range between about 253° C. and about 265° C., a hydroxyl number of about 285 mg KOH/g, a carbonyl number between about 0.1 mg KOH/g and about 0.2 mg KOH/g, a water content between about 0.05 wt % and about 0.1 wt % and a viscosity at 20° C. between about 17 mm$^2$/s and about 48 mm$^2$/s. See U.S. Patent Appl. No. 2011/0184105 Table 1a, incorporated herein by reference.

Methods of Making EXXAL™ Branched Alcohols: High Pressure Oxo Process

To synthesize the present extended branched alcohols, branched ethoxylates, extended branched ethoxylates, and functionalized branched alcohols, starting branched alcohols are available from Exxon Chemical Company under the trade name EXXAL™ . As described herein, EXXAL™ products are mixtures of branched primary alcohols having a mix of carbon numbers and isomers which are produced by catalytic hydroformylation or carbonylation of higher olefin feedstocks.

Hydroformylation is a process in which an olefin is reacted with carbon monoxide and hydrogen in the presence of a catalyst to form aldehydes and alcohols containing one carbon atom more than the feed olefin. See e.g., U.S. Pat. No. 6,482,972. The primary hydroformylation reaction is a reaction of olefin with carbon monoxide and hydrogen to produce aldehydes:

$$\text{Olefin}+CO+H_2 \rightarrow \text{Aldehyde}.$$

There are a number of simultaneous competing and consecutive reactions including:

$$\text{Olefin}+H_2 \rightarrow \text{Paraffin};$$

$$\text{Aldehyde}+H_2 \rightarrow \text{Alcohol; and}$$

$$\text{Aldehyde}+CO+H_2 \rightarrow \text{Formate ester},$$

where the aldehydes can condense with alcohols to form a hemi-acetal, $R^1$—CHOH—O—$R^2$, that is not very stable and can form an unsaturated ether to further react as follows:

$$\text{Unsaturated ether}+H_2 \rightarrow \text{di-alkyl ether; and}$$

$$\text{Unsaturated ether}+CO+H_2 \rightarrow \text{ether aldehyde},$$

where $R^1$ and $R^2$ independently represent alkyl chains and can be the same or different, unbranched (linear) or branched. Aldehydes can further condense with two alcohols to form an acetal, $R^1$—(O—$R^2$)$_2$.

Commercial hydroformylation processes are either a low or medium pressure process, or a high or medium pressure process. The low or medium pressure process typically involves the use as catalyst of an organometallic complex of rhodium with organophosphate ligands for providing the necessary stability at the lower pressures, and operates at pressures from 10 to 50 bar. The high or medium pressure process operates at pressures from 50 to 350 bar. Generally, low pressure processes are used for hydroformylation of unbranched and terminal, primarily lower olefins such as ethylene, propylene and n-butene, but can include n-hexene-1, n-octene-1 and mixtures of higher carbon number terminal olefins produced by the Fischer-Tropsch process. On the other hand, the high-pressure hydroformylation process is is used for linear and branched higher olefins such as those containing 5 or more carbon atoms to produce higher alcohols, aldehydes or acids in the $C_6$ to $C_{15}$ range, particularly the $C_9$ to $C_{13}$ range. High-pressure hydroformylation processes ("oxo reactions") involve the reaction of liquid materials with gaseous materials at least partially dissolved in the liquid during reaction. Gaseous materials can be entrained as droplets or bubbles in the liquid phase.

Starting materials of the high-pressure hydroformylation process include olefins or mixtures of olefins such as those obtained from olefin oligomerization units. For example, the olefins can be mixtures of $C_5$ to $C_{12}$ olefins obtained by the phosphoric acid-catalyzed oligomerization of $C_3$ and $C_4$ olefins and mixtures thereof. The olefin mixtures can be fractionated to obtain relatively narrow boiling cut mixtures of particular carbon number, which in turn can produce aldehydes and alcohols with the desired carbon number.

Alternatively, the olefins can be obtained by other oligomerization techniques such as dimerization or trimerization of butene using a nickel or nickel oxide catalyst, like the OCTOL® process or the process described in U.S. Pat. No. 6,437,170, or an oligomerization process for ethylene, propylene and/or butenes using a nickel salt and involving di-alkyl aluminum halides, like the range of DIMERSOL® processes, or a zeolite or a molecular sieve catalyst.

Olefins can also be obtained from ethylene processes, in which case $C_6$, $C_8$, $C_{10}$, or $C_{12}$, or even higher carbon numbers such as up to $C_{14}$, $C_{16}$, $C_{18}$, or even $C_{20}$ can be produced. Olefins can be mixtures obtained from the Fischer Tropsch process, which primarily contain terminal olefins but can have side branches along the longest alkyl chain, and which can also contain some internal olefins, linear and branched. The starting materials for the oligomerization units can be obtained from fluid catalytic cracking, steam cracking of gasses such as ethane and propane, liquids such as liquefied petroleum gas of naphtha, gasoil or heavier distillate, or whole crude from oxygenate-to-olefin processes and/or paraffin dehydrogenation processes.

The gaseous materials involved in the high pressure oxo process include carbon monoxide and hydrogen, frequently supplied in a mixture that is known as synthesis gas or "syngas". Syngas can be obtained through the use of partial oxidation technology, or steam reforming, or a combination thereof that is often referred to as autothermal reforming. It can be generated from almost every carbon-containing source material, including methane, natural gas, ethane, petroleum condensates like propane and/or butane, naphtha or other light boiling hydrocarbon liquids, gasoline or distillate-like petroleum liquids, and heavier oils and byproducts from various processes including hydroformylation, and even from coal and other solid materials like biomass and waste plastics. When using liquid feeds, a steam reformer can involve a pre-reformer to convert part of the feed to methane before entering the actual reformer reaction.

In an industrial hydroformylation plant producing alcohols, at least part of a hydroformylation product includes mixtures of alcohols, aldehydes and formate esters, and various other compounds, which can be subsequently hydrogenated to convert the aldehydes and formate esters to alcohols and reduce the level of the impurities. By way of example, conditions for hydrogenation are described in WO 2005/058782 at 3, 1.8 to 9, 1.10 and 25, 1.18 to 36, 1.20, incorporated herein by reference.

Hydroformylation reactions can be continuous or batch reactions. The continuous reactions generally take place in a series of two or more reactors. In an aspect, reactions can take place in a series of reactors involving gas lift reactors as lead or front-end reactors. In an aspect, the series of reactors can be loop reactors. The series of reactors can be separate distinct sections within one, or more than one, reaction vessel. Alternatively, one reactor in the series can comprise different volumes in series or in parallel.

The high pressure oxo process has three stages. In a first stage, or oxonation reaction, olefinic material and proper proportions of CO and $H_2$ are reacted in the presence of a carbonylation catalyst to yield a product comprising aldehydes having one more carbon atom than olefin reacted. Typically, alcohols, paraffins, acetals, and other species are also produced. An oxygenated organic mixture can contain various salts and molecular complexes of metal from catalyst (a "metal value") and is sometimes referred to as a crude aldehyde, or a crude hydroformylation mixture. In a second stage, or de-metaling stage, metal values are separated from crude aldehyde, such as by injecting dilute acetic acid. The crude hydroformylation mixture is then separated into phases: an organic phase comprising aldehyde separated from an aqueous phase. The organic phase is then converted to final product using downstream unit operations. In a third stage of the high pressure oxo process, metal values are processed for use in another process. These process stages can occur in three distinct vessels with numerous variations and improvements. Alternately, the stages can be combined.

Suitable processes to produce branched alcohols having from 6 to 15 carbon atoms per molecule are disclosed in numerous publications, for example in WO 2005/058782, WO 2005/58787, WO 2008/128852, WO 2008/122526, WO 2006/086067, WO 2010/022880, and WO 2010/022881. Certain processes can employ a "Kuhlmann" cobalt catalyst cycle, such as the process disclosed in WO 2008/122526. Improvements in efficiency of raw materials used, optimization of the recycle of unreacted materials, and the optimization of reaction conditions, material balance and other variables, can result in increases in conversion, output and efficiency. For example, oxonation processes occur in a reactor having an operating pressure between about 300 psig and about 1500 psig, an operating temperature between about 125° C. and about 200° C., a catalyst to olefin ratio of between about 1:1 and about 1:1000, and a molar ratio of hydrogen to carbon monoxide between about 1:1 and about 10:1. See, WO 03/082788 A1 at ¶ [0039].

Methods of Making Extended Branched Alcohols

The present extended branched alcohols are novel surfactant precursors that can be produced from the commercial EXXAL™ branched alcohols by different methods and processes. Alcohols are generally poor electrophiles for alkylation reactions, requiring activation of the hydroxyl into a suitable leaving group in order to facilitate nucleophilic substitution. Therefore, one strategy for alcohol activation involves the removal of hydrogen from the alcohols to form aldehydes, which undergo in situ conversion into alkenes prior to return of hydrogen to afford a net alkylation process. This oxidation/alkene-formation/reduction sequence has been referred to as a "borrowing hydrogen" methodology. See, Pridmore, Simon J., et al., C—C *Bond Formation from Alcohols and Malonate Half Esters Using Borrowing Hydrogen Methodology*. Tetrahedron Letters, 49 (2008) 7413-7415.

More specifically, in the borrowing hydrogen methodology, alkylation reactions of alcohols can be achieved using simple esters and the conversion of ROH into $RCH_2CO_2R'$ and malonate half-esters as convenient reagents for alkylation reactions according to the pathway outlined in a general Scheme I below. Id.

Scheme I

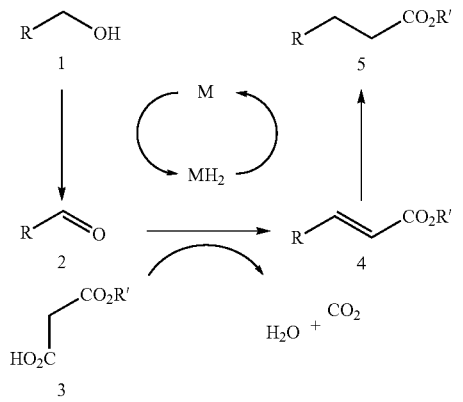

Using Scheme I, temporary removal of hydrogen from alcohols 1 generates aldehydes 2 which undergo a decarboxylative Knoevenagel reaction with malonate half esters 3, yielding α, β-unsaturated esters 4. Return of the hydrogen by alkene reduction would then provide overall alkylation products 5. The decarboxylative Knoevenagel reaction of aldehydes is a process, which is usually catalyzed by a suitable amine. Id. citing Klein, J, et al., J. Am. Chem. Soc. 1957, 79, 3452. The only by-products formed in the decarboxylative Knoevenagel reaction are water and carbon dioxide. Hence, the process provides a useful reaction for the conversion of aldehydes into α, β-unsaturated esters.

An exemplary reaction is shown in Scheme II immediately below:

Scheme II

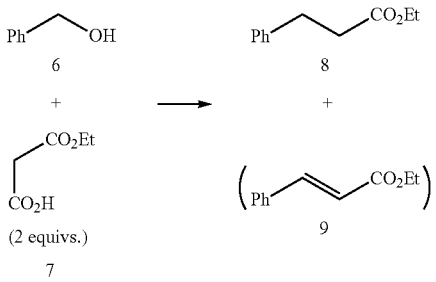

In this process, benzyl alcohols 6 react with monoethyl malonate 7 to convert the benzyl alcohols 6 into ethyl dihydrocinnamate 8 (alkylated products) and alkene by-products 9.

For borrowing hydrogen methodologies, various catalysts can be used including Ru or Ir catalysts. Further, pyrrolidine can be used as an organo-catalyst based on its ability to affect the decarboxylative Knoevenagel reaction. *Id. citing* Klein, J., et al., 79 J. Am. Chem. Soc. 1957, 3452. For example, the following transition metals can convert alcohols into alkylated products: (i) $Ru(PPh_3)_3$-$(CO)H_2$/xantphos which is also useful in hydrogen transfer reactions; (ii) $Ru(PPh_3)_3Cl_2$/KOH as a readily available Ru(II) source; and (iii) $[Cp^*IrCl_2]_2/Cs_2CO_3$ for a good effect in C—C and C—N bond-forming reactions from alcohols. Id. citing Fujita, K., Synlett 2005, 560.

A summary of exemplary reactions for formation of esters 5 from alcohols 1 are provided in Table 3 below:

TABLE 3

| Catalyst[a] | Conv.[b] (%) | Time (h) | 8:9 C—C:C═C |
|---|---|---|---|
| $Ru(PPH_3)_3(CO)H_2$/xantphos | 100 | 24 | 62:38 |
| $Ru(PPH_3)_3Cl_2$/KOH | 100 | 24 | 92:8 |
| $Ru(PPH_3)_3Cl_2$/KOH | 93 | 4 | 82:11 |
| $[Cp^*IrCl_2]/Cs_2CO_3$ | 100 | 24 | 100:0 |
| $[Cp^*IrCl_2]/Cs_2CO_3$ | 79 | 4 | 76:3 |

[a]Catalyst loading was 2.5 mol % (i.e., 2.5 mol % in Ru or 5 mol % in Ir).

[b]Conversion was established by analysis of the $^1H$ NMR spectrum.

Pridmore, Simon J., et al., C—C *Bond Formation from Alcohols and Malonate Half Esters Using Borrowing Hydrogen Methodology.* Tetrahedron Letters, 49 (2008) 7413-7415 at 7414.

As set out in Table 3, a comparison of conversions achieved after four hours using the $Ru(PPh_3)_3Cl_2$/KOH and $[Cp^*IrCl_2]_2/Cs_2CO_3$ catalysts revealed that the ruthenium catalyst was slightly more effective. As reported, effective catalyst loading can be lower for a Ru catalyst than an Ir catalyst. Further, in order to overcome any problems of unreacted alkene, isopropanol can act as a hydrogen donor to replace any lost $H_2$.

More generally, alcohols can be converted into the doubly homologated esters 10 using Scheme III below.

Scheme III

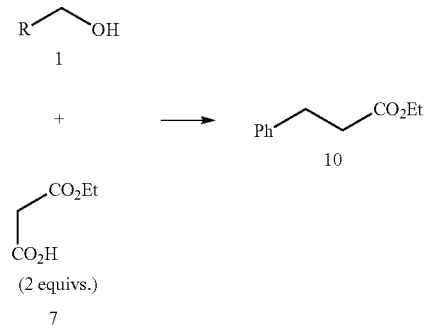

In an aspect, alcohols 1 and malonate half esters 7 are combined with 2.5 mole % $Ru(PPh_3)3Cl_2$, 6.25 mole % KOH, 30 mole % pyrrolidine and 20 mole % $(CH_3)_2CHOH$ and refluxed for 24 hours. Noteworthily, electron-deficient alcohols and aliphatic alcohols can be less reactive and can require a higher catalyst loading to reach completion. The lower reactivity of the alcohols parallels the expected ease of oxidation for the substrates.

By using borrowing hydrogen methodology and malonate half esters, EXXAL™ branched alcohols can be converted into doubly homologated esters (also referred to herein as extended branch esters) which can undergo a decarboxylative Knoevenagel reaction on the intermediate aldehydes to produce the present extended branched alcohols.

Alternative methods for producing the present extended branched alcohols include α-alkylation of esters. In these processes, α-alkylation of esters utilizes the alcohols as alkylating agents. Industrially, alcohols are typically more environmentally benign and less expensive than alkyl halides. Hence, alkylation with primary alcohols using the "borrowing hydrogen" methodology have emerged as green processes for C—C bond formations. See, Guo, L. et al., *A General and mild Catalytic Alkylation of Unactivated Esters Using Alcohols,* Angew. Chem. Int. Ed. 2015, 54, 4023-4027.

By way of example as shown in Scheme IV below, the primary alcohols are varied using an NCP/Ir catalyst and operating under optional reaction conditions, benzylic alcohols 11 (containing both electron-donating and electron-withdrawing groups) alkylated efficiently. Id. at 4024.

Scheme IV

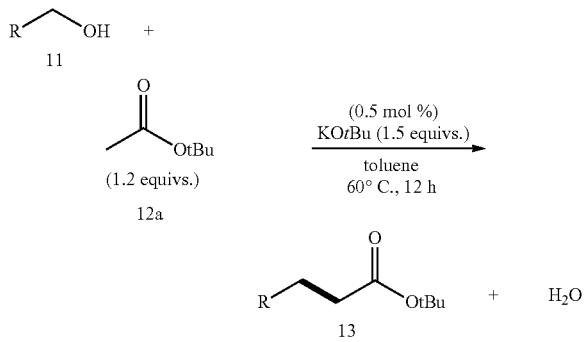

-continued

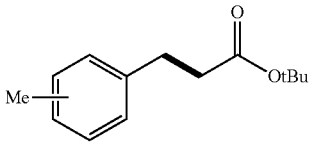

o-Me, 13b, 82%
m-Me, 13c, 89%
p-Me, 13d 85%

13e

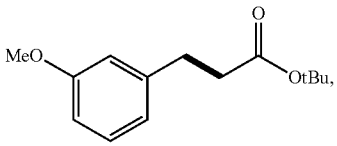

85%

13f

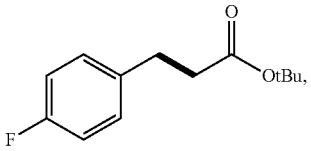

79%

13g

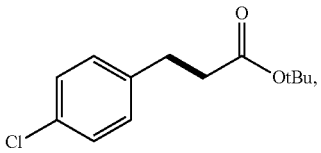

72%

13h

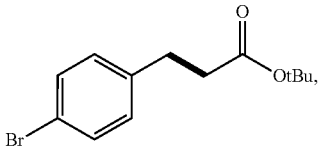

65%

13i

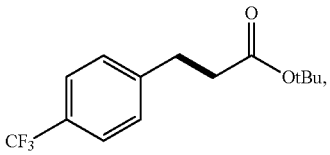

82%

13j

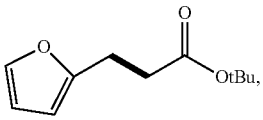

67%

13k

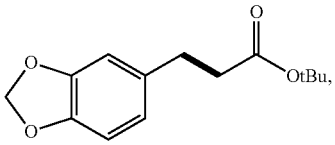

73%

-continued

13l

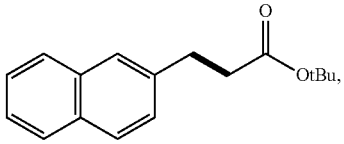

87%

13m

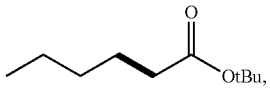

71%

13n

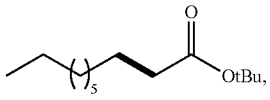

81%

13o

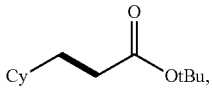

73%

13p

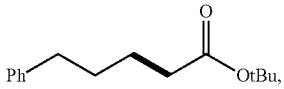

65%

13q

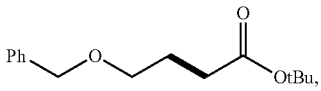

71%

As reported, couplings of nonbenzylic primary alcohols (11m-q) and 12a formed products 13m-q in useful yields. Id. The catalyst system allowed for the alkylation of un-activated substituted esters with primary alcohols. Id.

Suitable catalysts for ester alkylation with alcohols can include, but are not limited to, pincer-type iridium catalysts used at low catalyst loading with alcohol to ester ratios of about 1:1. Pincer-type iridium catalysts can include NCP, PCP, POCOP complexes, and the like.

Extended branched esters can then be converted to extended branched alcohols by reduction. By way of example, reduction of extended branched esters 14 using lithium aluminum hydride to yield the corresponding extended branched alcohols 15 is shown below in Scheme V. Here the alkyl esters are reduced to alcohols to provide the present extended branched alcohols.

Scheme V

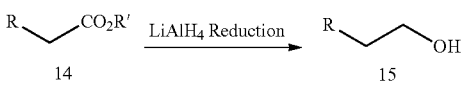

Other alternative methods of producing extended branched alcohols can include reduction of unsaturated extended branched esters 16 to extended branched alcohols 17 using catalytic hydrogenation as shown in Scheme VI immediately below. Similar reduction chemistries capable of reducing esters and double bonded carbons can also be used. Reduction of unsaturated extended branched esters 16 to the extended branched alcohols 17 can be performed stepwise through saturation of the double bond first, followed by reduction of the esters. Similarly, the esters of the unsaturated extended branched esters 16 can be reduced or hydrolyzed first, followed by reduction to the extended branched alcohols 17.

Scheme VI

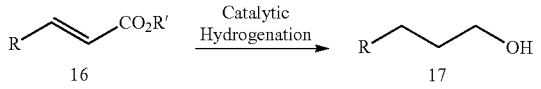

Another alternative for the production of the present extended branched alcohols includes a process of oxidation of alcohols to aldehydes, followed by olefination and reduction to yield the extended branched alcohols. As shown in Scheme VII below, methods of olefination are preceded by the oxidation of alcohols using the (a) Parikh-Doering protocol to generate the corresponding aldehydes, followed by a (b) Horner-Wadsworth-Emmons olefination to give unsaturated esters 19. Such processes include stepwise oxidation and olefination and are described by Dineen T A, et al., *Total Synthesis of Cochleamycin A*, Org. Lett. Vol. 6, (2004) 2043-2046.

Scheme VII

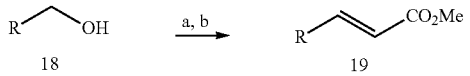

Similarly, two-carbon extension of alcohols by oxidation, olefination, and then reduction is shown below in Scheme VIII. Oxidation of primary alcohols 24 by using the Parikh-Doering protocol gave the corresponding aldehydes, which were subjected to standard Horner-Wadsworth-Emmons olefination to give esters 25. Reduction of 25 with DIBAL-H gave allylic alcohols 26. A subsequent hydrogenation of allylic alcohols 26 would then yield extended branched alcohols.

Scheme VIII

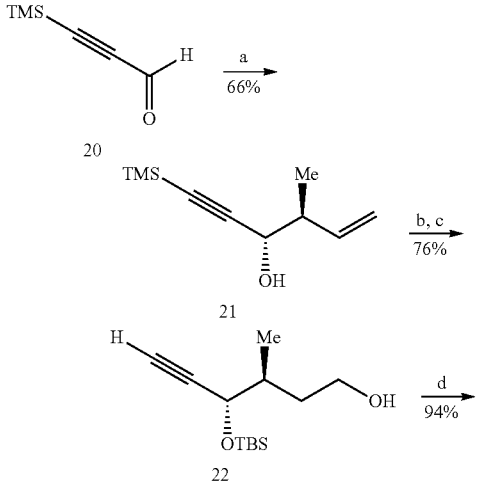

-continued

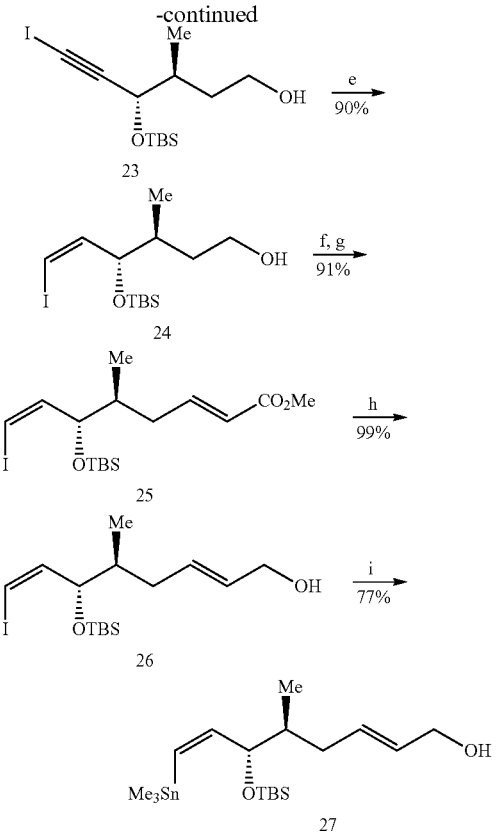

Conditions for Scheme VIII have heen reported as: (a) $(^{d}Ipc)_2B$-crotyl, THF, −78° C., then $NaBO_3 \cdot H_2O$. (b) TBS-OTf, 2,6-lutidine, $CH_2Cl_2$, −78° C. (c) 9-BBN, THF, then aqueous $NaOH/H_2O_2$. (d) n-BuLi, THF, −50° C., then $I_2$. (e) o-Nitrobenzenesulfonylhydrazide, $Et_3N$, THF/i-PrOH (1:1). (f) $SO_3 \cdot$pyr, DMSO, $iPr_2NEt$, $CH_2Cl_2$, 0° C. (g) Trimethyl phosphonoacetate, LiCl, $Et_3N$, $CH_3CN$. (h) DIBAL-H, $CH_2C_2$. (i) MeLi, $Et_2O$, −40 to 23° C.; n-BuLi, −78° C.; then $Me_3SnCl$, THF, −78° C. Id. at 2044.

Construction of fragments 27 began with asymmetric (E)-crotylboration of aldehydes 20, which gave anti homoallylic alcohols 21. Protection of the hydroxyl group of 21 as TBS ethers and then hydroboration of the vinyl group with 9-BBN and cleavage of the alkynylsilane unit during oxidation of the alkylborane provided primary alcohols 22. These intermediates were iodinated in 94% yield by treatment with n-BuLi in THF (−50° C.) and then $I_2$. (Z)-Vinyl iodides 24 were then prepared by reduction of alkynyl iodides 23 with diimide (generated in situ from o-nitrobenzenesulfonylhydrazide and $Et_3N$). Oxidation of primary alcohols 24 using the Parikh-Doering protocol gave the corresponding aldehydes, which were subjected to standard Horner-Wadsworth-Emmons olefination to give esters 25. Reduction of 25 with DIBAL-H gave allylic alcohols 26. Finally, sequential treatment of 26 with MeLi ($Et_2O$, −78° C.) and then n-BuLi (−78° C.), followed by addition of $Me_3SnCl$, then provided vinylstannanes 27. Id.

Generally, Scheme VIII describes a process of oxidizing primary alcohols 24 using the Parikh-Doering protocol, subjecting the resulting aldehydes to Homer-Wadsworth-Emmons olefination to yield esters 25, and reduction to yield allylic alcohols 26. A further step of hydrogenating allylic alcohols 26 could be taken to produce primary alcohols. Hence, this process can be utilized to produce the present extended branched alcohols.

The extended branched alcohols can be used as chemical intermediates in the manufacture of plasticizers, detergents, solvents and the like, or in the production of lubricant esters such as the esters of phthalic acid and anhydride, esters of cyclohexane mono- or dicarboxylic acids, esters of adipic or tri-mellitic acid, esters of the various isomers of pyromellitic acid and polyol esters. More specifically, the extended branched alcohols can be used in surfactant derivatives as described below.

Methods of Making Extended Branched Ethoxylates

Alcohol ethoxylates are a class of compounds that are used throughout many industrial practices and commercial markets. Generally, these compounds are synthesized via the reaction of branched alcohols and ethylene oxide, resulting in molecules that consists of two main components: (1) an oleophilic, carbon-rich, branched alcohol also referred to herein as a hydrophobic moiety; and (2) a hydrophilic, polyoxyethylene chain also referred to herein as a hydrophilic moiety.

Due to the basic structure of these compounds that pair a hydrophobic moiety with a hydrophilic moiety, ethoxylated alcohols such as the present branched ethoxylates and extended branched ethoxylates are a versatile class of compounds commonly referred to as surfactants. Generally, ethoxylate surfactants enhance the mixing and solubilization of oil and water by comprising contrasting moieties within the same compound. Having amphiphilic structure, a single molecule can inhabit the interface of two immiscible phases (i.e. oil and water), effectively bringing them closer together and lowering the interfacial energy ("IFT") associated between them. By lowering this energy, many novel solution applications can be accessed by increasing the homogeneity of these two previously immiscible phases.

Generally, alcohol ethoxylates can vary widely in their properties and applications because the materials used to make these products can vary in their structures and amounts. Conversely, branched alcohols synthesized from petroleum products, including the extended branched alcohols provided herein, offer unique structures in the hydrophobic moiety that are not commonly observed in nature. As further provided, the present extended branched alcohols have specific carbon distributions with lower branching, and can be attained using the EXXAL™ branched alcohols as synthetic starting materials.

Alcohol ethoxylates ("AEOs") are neutral surfactants, widely used in both industrial and consumer product applications. Highly branched AEOs can be characterized as having an inverse relationship between degree of branching and biodegradation. Data developed for AEOs derived from branched $C_8$-rich, $C_9$-rich, $C_{10}$-rich, $Cu_{11}$-rich and $C_{13}$-rich oxo-alcohols with 1 to 20 moles of ethoxylation is provided in Table 4 immediately below.

TABLE 4

| Alcohol | Alcohol C No. Distribution | Alcohol branches/ molecule | Details Major isomers [Feedstock] | Representative Ethoxylate CAS name/number | EO Range Tested |
|---|---|---|---|---|---|
| EXXAL ™ 8 | 7-9 | 1.59 | methyl-1-heptanols, dimethy1-1-hexanols. [Heptane (proplyene/butene dimer)] | Alcohols, $C_{7-9}$-iso-, $C_8$-rich, ethoxylated 78330-19-5 | 4-10 |
| EXXAL ™ 9 | 8-10 | 1.88 | methyl-1-octanols, dimethy1-1-heptanols. [Octene (Butene-rich olefin dimer)] | Poly(oxy-1,2-ethanediyl), α-isononyl-Ω-hydroxy-(9Ci) 56619-62-6; Poly(Oxy-1,2-Ethanediyl), α-Nonyl-Ω-Hydroxy-branched (No CASRN assigned) | 1-20 |
| EXXAL ™ 10 | 9-11 | 2.03 | dimethyl-1-octanols, trimethyl-1 heptanols. [Nonene (propylene trimer)] | Alcohols, $C_{9-11}$-Iso-, $C_{10}$-Rich, Ethoxylated 78330-20-8 | 3-9 |
| EXXAL ™ 11 | 10-12 | 2.23 | dimethyl-1-nonanols, trimethyl-1-octanols. [Decenes (Propylene/butene trimer)] | Alcohols, $C_{9-11}$-Branched, Ethoxylated 169107-21-5; Poly(Oxy-1,2-Ethanediyl), α-Isoundecyl-Ω-Hydroxy-(9Ci) 140175-09-3 | 3-10 |
| EXXAL ™ 13 | 12-14 | 3.06 | trimethyl-1-decanols, tetramethyl-1-nonanols. [Dodecenes (Propylene tetramer)] | Alcohols, $C_{11-14}$-iso-, $C_{13}$-rich, ethoxylated 78330-21-9 | 3-12 |

Figure 4:
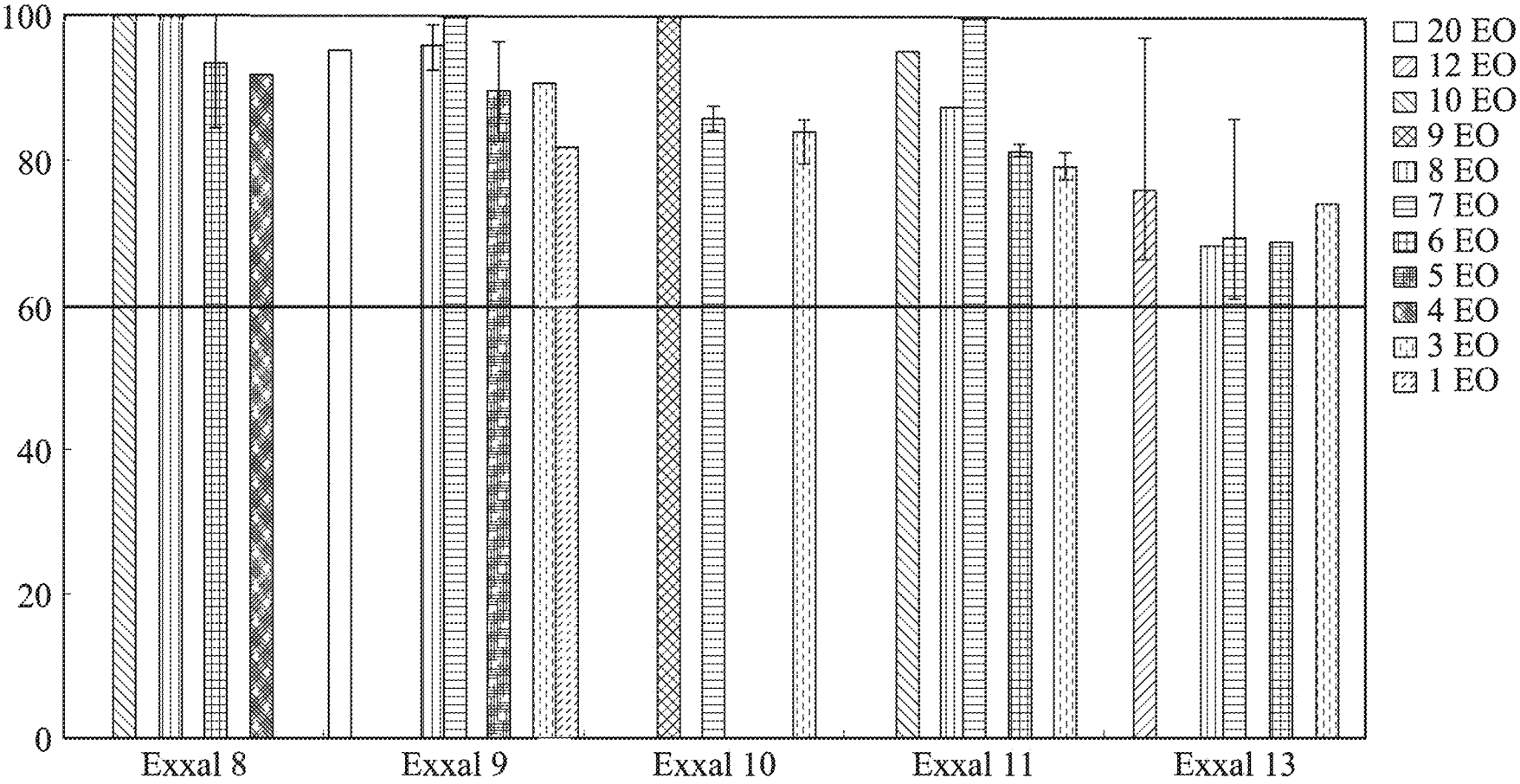
FIG. 4 are bar graphs showing EXXAL™ branched ethoxylates pass the threshold (horizontal line) and classify as readily biodegradable (28 d Manometric Respirometry, Closed Bottle and $CO_2$ Evolution tests). Linear data from Danish EPA (Madsen, 2001), HERA (2009).
Figure 5:
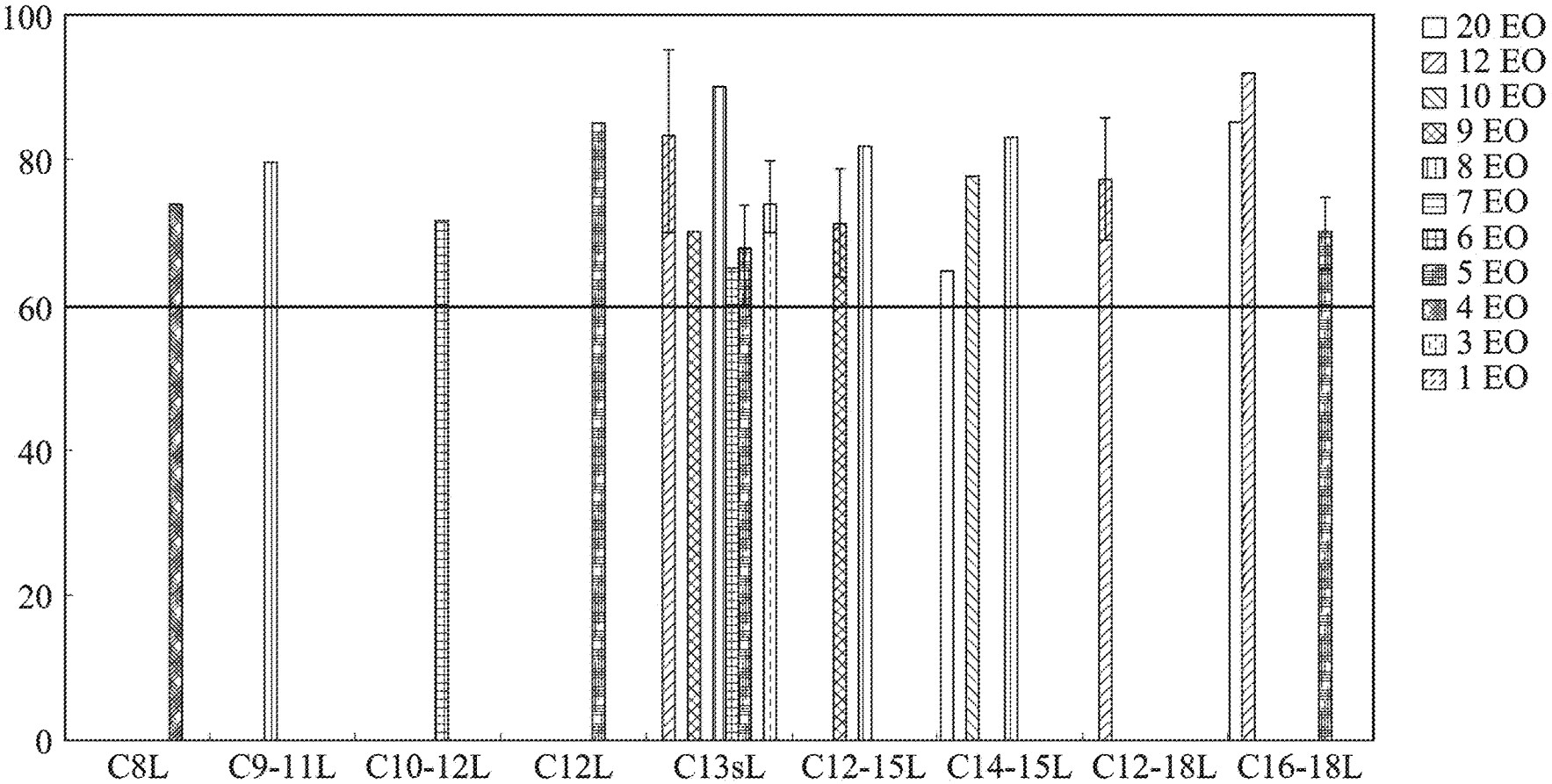
FIG. 5 are bar graphs showing linear alcohol ethoxylates pass the threshold (horizontal line) and classify as readily biodegradable (28 d Manometric Respirometry, Closed Bottle and $CO_2$ Evolution tests). Linear data from Danish EPA (Madsen, 2001), HERA (2009).

Also, as shown in FIG. 4 and FIG. 5, these ethoxylates are readily biodegradable. Biodegradability data for AEOs derived from branched $C_8$-rich, $C_9$-rich, $C_{10}$-rich, $Cu_{11}$-rich and $C_{13}$-rich oxo-alcohols with 1 to 20 moles of ethoxylate is provided in Table 5 immediately below.

TABLE 5

| Substance | Day 28 % biodeg. | 10 d window |
|---|---|---|
| EXXAL ™ 8-4EO | 92 | ✓ |
| EXXAL ™ 8-6EO | 84, 103[a] | ✓ |
| EXXAL ™ 8-8EO | 100 | ✓ |
| EXXAL ™ 8-10EO | 107[a] | ✓ |
| EXXAL ™ 9-1EO | 82 | ✓ |
| EXXAL ™ 9-3EO | 91 | ✓ |
| EXXAL ™ 9-5EO | 83, 97 | ✓ |
| EXXAL ™ 95-7EO | 102[a] | ✓ |
| EXXAL ™ 9-8EO | 93, 99 | ✓ |
| EXXAL ™ 9-20EO | 95 | ✓ |
| EXXAL ™ 10-3EO | 80-86 | ✓* |
| EXXAL ™ 10-7EO | 84, 88 | ✓ |
| EXXAL ™ 10-9EO | 112[a] | ✓ |
| EXXAL ™ 11-5EO | 81, 82 | ✓* |
| EXXAL ™ 11-7EO | 106[a] | ✓ |
| EXXAL ™ 11-8EO | 87 | ✓ |
| EXXAL ™ 11-10EO | 95 | ✓ |
| EXXAL ™ 13-8EO | 67-68 | ✓* |
| EXXAL ™ 13-12EO | 66-97 | ✓* |

[a]60% by 7 d; 76-95% end of 10-day window.
*In some studies

AEO surfactants derived from branched $C_8$-rich, $C_9$-rich, $C_{10}$-rich, $C_{11}$-rich and $C_{13}$-rich oxo-alcohols with 1 to 20 moles of ethoxylate meet the OECD readily biodegradable criteria, and are expected to undergo rapid and ultimate degradation in the environment.

As further provided herein, the length of the polyoxyethylene component (i.e. the hydrophilic moiety) of the branched ethoxylates and extended branched ethoxylates provides a class of compounds having unique water solubilities and detergency properties. For example, an increase of ethylene oxide can increase water solubility, as well as increase the hydrophilic/lipophilic balance ("HLB") of the compound. Ranging in arbitrary units of 1-20, the HLB of a nonionic surfactant can be calculated and used to determine the propensity of a compound to work effectively in a given solution of oil and water. Lower HLB values (<10) are commonly used for oil-rich solutions while surfactants with higher HLB values (>10) are typically most efficient in oil-in-water emulsions.

The present branched alcohols and extended branched alcohols can be ethoxylated with alkylene glycol to produce the present branched ethoxylates and extended branched ethoxylates for surfactant applications. Ethoxylation of branched alcohols and extended branched alcohols can be prepared by any method suitable for generating ethers, such as Williamson ether synthesis. Ethoxylation methods can include direct reaction of alcohols with alkylene glycol or polyalkylene glycol. By way of example, ethoxylation of alcohols with polyols is described in U.S. Pat. No. 3,929,678.

Methods of ethoxylation include activation of alcohol substituents of branched alcohols or extended branched alcohols by tosylation or substitution by a halogen, i.e., Cl, I, or Br, followed by reaction with alkylene glycol or polyalkylene glycol where the glycols are reacted with a reagent such as NaH first. In an aspect, ethoxylation of branched alcohols or extended branched alcohols 28 can proceed as shown in Scheme IX below. In this example, branched alcohols or extended branched alcohols 28 are reacted with tosyl chloride to generate the corresponding tosylate esters 29, which are then reacted with polyethylene glycol to yield branched ethoxylates or extended branched ethoxylates 30.

Scheme IX

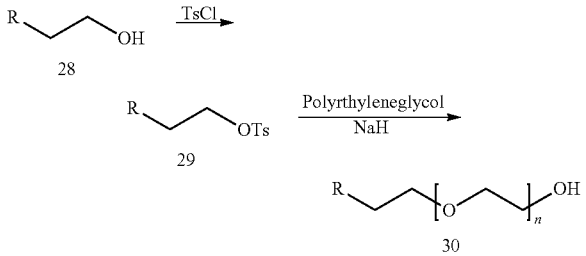

In addition, ethoxylation is sometimes combined with propoxylation, an analogous reaction using propylene oxide as the monomer. Both reactions are normally performed in the same reactor and can be run simultaneously to give a random polymer, or in alternation to obtain block copolymers such as poloxamers.

Generally, ethoxylates are surfactants useful in products such as laundry detergents, surface cleaners, cosmetics, agricultural products, textiles, and paint. Alcohol ethoxylate-based surfactants are non-ionic and often require longer ethoxylate chains than their sulfonated analogues in order to be water-soluble. Ethoxylation is also practiced, albeit on a much smaller scale, in the biotechnology and pharmaceutical industries to increase water solubility and, in the case of pharmaceuticals, circulatory half-life of non-polar organic compounds. Generally, branched ethoxylates and extended branched ethoxylates are not expected to be mutagenic, carcinogenic, or skin sensitizers, nor cause reproductive or developmental effects.

Modification of Branched Ethoxylates to Yield Functionalized Branched Alcohols

The present functionalized branched alcohols can be produced from branched ethoxylates and/or the extended branched ethoxylates described herein.

As described herein, the branched ethoxylates are attached to glycosyl acetate, or other protected cyclic form of a monosaccharide or by extension, of a lower oligosaccharide, in the presence of an acid (i.e., Lewis acid). The acetate or other protecting group is then removed with a base to provide the functionalized branched alcohols comprising a glycosyl group coupled to an ethylene oxide linker ("EO linker") and a tail derived from the branched alcohols. The tail comprises paraffins and branches and various isomers. The ethylene oxide linker comprises one or more units of ethylene oxide or as described below three or more units of ethylene oxide or in an aspect, three units of ethylene oxide.

The present methodology is shown generally in Scheme X below. The branched ethoxylates 31 are attached to the protected glycosyl group in the presence of an acid (acid catalyst) to form the functionalized branched alcohols 32 having the glycosyl group $R^2$ attached to the EO linker and tail.

Scheme X

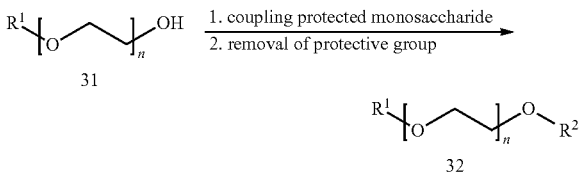

Scheme XI

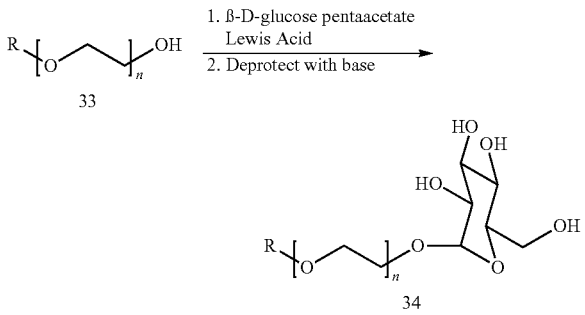

In the present methods, reactants can include one or more protected alcohol substituents, such as an acetate, in order to decrease glycosyl oligomerization and the formation of byproducts. Attachment of the glycosyl group to the branched ethoxylates can be performed by various methods, including coupling reactions in the presence of an acid catalyst. See, e.g., U.S. Pat. No. 5,644,041. Col. 1, 1.63 to Col. 2, 1.5. For example, acid catalysts or activators can include Lewis acids (such as $ZnCl_3$, triflate salts, $BF_3$-etherate, trityl perchlorate, and $AlCl_3$) and Bronsted acids (such as TsOH, $HClO_4$, sulfamic acid). Furthermore, while the alcohol in the C-1 position of the glycosol group is often protected as an acetate, other alcohols in the glycosyl group can be protected with benzyl or benzoate protecting groups or other protecting groups that do not interfere with subsequent method steps.

For reactions catalyzed with Lewis acids, suitable Lewis acids can include compounds capable of accepting electron pairs, and able to react with a Lewis base to form a Lewis adduct as defined in Pure and Applied Chemistry, Volume 66, Issue 5, Page 1135. Suitable Lewis acids and Bronsted acids are described, for example, in U.S. Pat. Pub. 2014/0323705 at ¶¶ [0192] & [0193]. Specific Lewis acids include, but are not limited to, any one or more of boron trifluoride, $SbCl_5$, $CuCl_2$, $PbCl_2$, $GeCl_2$, $SnBr_2$, $SnI_2$, $CoBr_2$, $SnC_{14}$, $GaCl_3$, $FeCl_3$, $TiCl_4$, $AlCl_3$, $AlF_3$, $InCl_3$, $SnCl_2$, $ScCl_3$, $ZrCl_4$, $CrCl_3$, $CoCl_{13}$, FeCl, $CoCl_2$, $NiCl_2$, $CuCl_2$, $CH_3CO^+$, $Cu^+$, $Au^+$, $Hg^{2+}$, $Pb^{2+}$, $ZnCl_2$, $ZnBr_2$, $ZnF_2$, $ZnI_2$, $ZnMe_2$, $ZnEt_2$, and/or $ZnPh_2$.

More specifically, as shown in Scheme XI, the present methods include the step of reacting the branched ethoxylates 33 with a protected glucose in the presence of a Lewis acid catalyst. Once attached to the ethylene oxide linker and tail (the R group as shown), the protecting group can be removed with a base to form the functionalized branched alcohols 34. Various methods for deprotecting the glycosyl group exist. Appropriate methods depend on the protecting group used. For example, acetate protective groups are removed with a base, whereas benzyl protective groups are removed through hydrogenation.

The present methods can modify the branched ethoxylates with glycosyl groups such as substituent structures of hexoses, and pentoses. Specific examples of suitable glycosyl groups include cyclic forms of monosaccharides such as glucose, mannose, galactose, sorbose, fructose, xylose, arabinose, ribose, lyxose, lactose, and maltose. Surfactants The present functionalized branched alcohols are useful as non-ionic surfactants (or non-ionic sugar surfactants). As described herein, surfactants are amphiphilic molecules having two different moieties in a single molecule. Surfactants have a hydrophobic moiety, also referred to as a hydrophobe or tail, that can include branched or linear alkyl hydrocarbons, such as branched alcohols, or alkylaryl hydrocarbons, such as nonylphenyl hydrocarbons. Surfactants also have a hydrophilic moiety that can include anionic groups (i.e., sulfates, sulfonates, etc.), nonionic groups (i.e., ethoxylates, propoxylates, etc.), cationic groups (i.e. amines), or zwitterionic groups (i.e., sultaines, betaines, etc.).

Basically, surfactants help linking immiscible liquid phases by adsorbing at the interface of the two. For example, surfactants can act at the interface of water and oil to create an emulsion. Surfactants alter the surface and interfacial properties of the liquid. Attaching weak hydrophilic groups to the hydrophobic moiety can reduce solubility and increase the Krafft point. Solubilizers are sometimes added to mitigate solubility problems.

Surface tension or interfacial tension ("IFT") is a surfactant property often reported as force/distance (i.e. N/m) and corresponds to a unit of energy per unit area. The IFT, the free energy required to create more surface interfaces, is reduced when a surfactant is present. Other surfactant properties include cloud point, pour point, foaming, and wetting. Surfactant derivatives based on the present branched alcohols and extended branched alcohols are expected to offer improved properties, superior wetting performances, and fewer gel phases.

Surfactants can create stable emulsions for creams and lotions, lift oils and dirt from clothes and skin, help formulation of fluids such as paint, and have numerous other industrial applications such as those as identified in Table 6.

TABLE 6

| Industry | Application | ST/IFT* decrease | Fast Wetting | Emulsification | Caustic Stability | Phase Behavior (less gels) | Low Foaming |
|---|---|---|---|---|---|---|---|
| Textiles | Pretreatment (sizing, scouring, de-sizing) | ✓ | ✓ | ✓ | ✓ | | |
| | Bleaching | | ✓ | | ✓ | | |
| | Dyeing | | ✓ | | | | ✓ |

TABLE 6-continued

| Industry | Application | ST/IFT* decrease | Fast Wetting | Emulsification | Caustic Stability | Phase Behavior (less gels) | Low Foaming |
|---|---|---|---|---|---|---|---|
| Agricultural | Adjuvants (wetting, spreading) | ✓ | | ✓ | | ✓ | ✓ |
| | Suspension concentrates | | ✓ | ✓ | | ✓ | ✓ |
| Emulsion polymerization | | | | ✓ | | ✓ | |
| I&I cleaning | Wetting Agents | | ✓ | | ✓ | ✓ | ✓ |
| | Detergents | | ✓ | ✓ | ✓ | ✓ | ✓ |
| Leather | Wetting, soaking degreasing | | ✓ | ✓ | | ✓ | |
| Petroleum, oil | Enhanced oil recovery | ✓ | | ✓ | | ✓ | |
| | Emulsion breakers | | | | | ✓ | |
| | Dispersants | | | ✓ | | ✓ | |
| Mining | Frothers, flotation | ✓ | | | | ✓ | |
| Detergents | Textiles | ✓ | ✓ | ✓ | | ✓ | |
| | Hard surface cleaners | ✓ | ✓ | | | ✓ | ✓ |
| | Dishwashing-antifoams | | | | | | ✓ |
| Personal Care | Shampoos | | | ✓ | | | |

*ST: surface tension
*IFT: interfacial tension

Therefore, surfactants are often used in the production of plasticizers or lubricant esters such as the esters of phthalic acid and anhydride, esters of cyclohexane mono- or dicarboxylic acids, esters of adipic or tri-mellitic acid, esters of the various isomers of pyromellitic acid, and polyol esters.

The features of the invention are described in the following non-limiting examples.

EXAMPLE 1

Synthesis of Functionalized Branched Alcohols

In this example and as shown below in Scheme XII, EXXAL™ 11 was first ethoxylated by conversion of EXXAL™ 11 to EXXAL™ 11 tosylate esters, followed by reaction with triethylene glycol in the presence of sodium hydride. The ethoxylated EXXAL™ 11 was then coupled to β-D-glucose pentaacetate in the presence of a Lewis acid. Next, the acetate groups were removed with a base to provide the functionalized branched alcohols. EXXAL™ 11 is a mixture wherein $C_{11}H_{23}$ represents the main component of the EXXAL™ 11 mixture.

Scheme XII

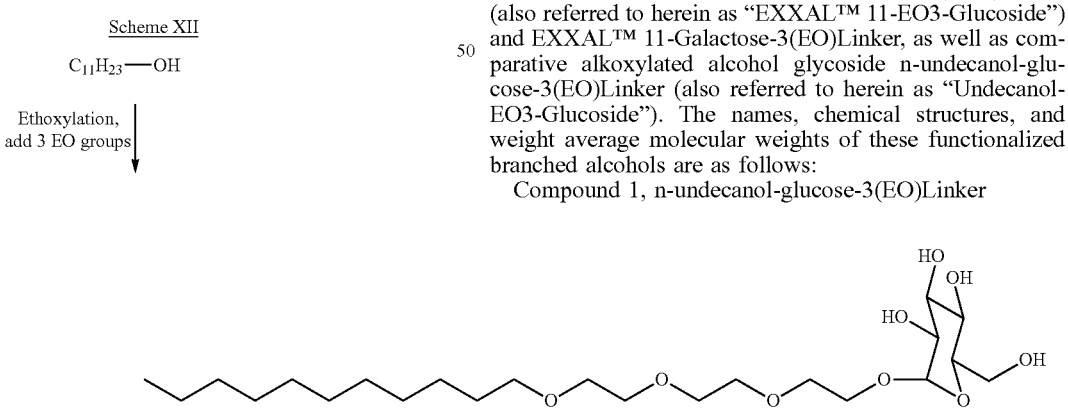

EXAMPLE 2

Non-ionic Sugar Surfactant Performance

In the next example, surface tension measurements were taken to demonstrate surface activity for functionalized branched alcohols and a comparative linear alcohol. Surface tension isotherms were measured for selected functionalized branched alcohols EXXAL™ 11-Glucose-3(EO )Linker (also referred to herein as "EXXAL™ 11-EO3-Glucoside") and EXXAL™ 11-Galactose-3(EO)Linker, as well as comparative alkoxylated alcohol glycoside n-undecanol-glucose-3(EO)Linker (also referred to herein as "Undecanol-EO3-Glucoside"). The names, chemical structures, and weight average molecular weights of these functionalized branched alcohols are as follows:

Compound 1, n-undecanol-glucose-3(EO)Linker

Chemical Formula: $C_{23}H_{46}O_9$
Molecular Weight: 466.61

Compound 2, EXXAL™ 11-Glucose-3(EO)Linker

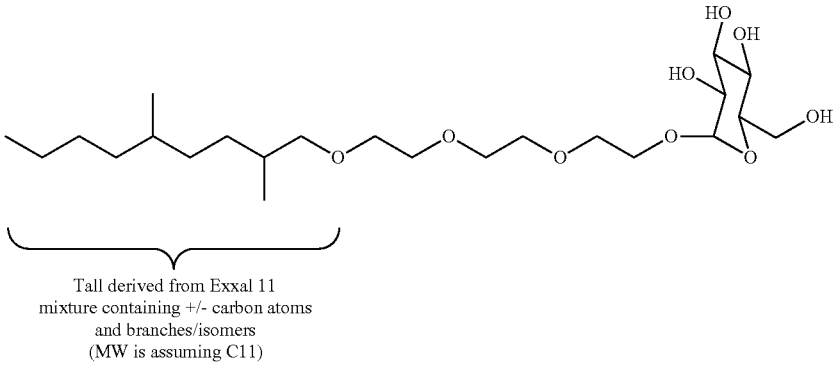

Chemical Formula: $C_{23}H_{46}O_9$
Molecular Weight: 466.61

Compound 3, EXXAL™ 11-Galactose-3(EO)Linker

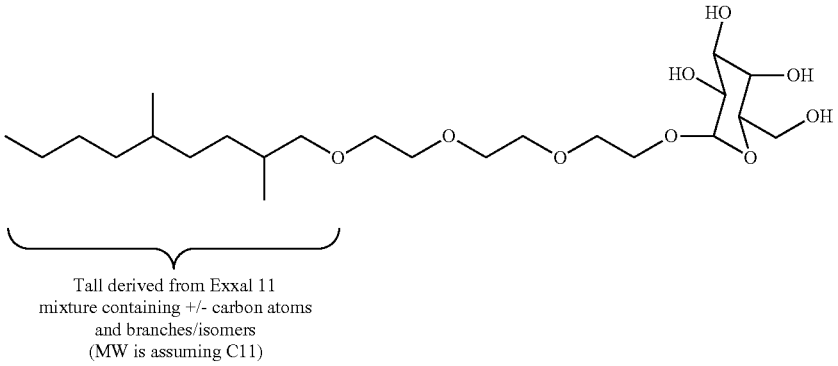

Chemical Formula: $C_{23}H_{46}O_9$
Molecular Weight: 466.61

The compounds were water soluble over the measured concentration ranges without any addition of solubilizers and/or complexing agents (which were needed in a previous invention, see U.S. Pat. No. 5,644,041).

Tables 7, 8 and 9 immediately below provide surface tension isotherms for the compounds 1, 2, and 3 measured at 22° C. Specifically, Table 7 provides surface tension data of n-undecanol-glucose-3(EO)Linker, Table 8 provides surface tension data of EXXAL™ 11-Gluscose-3(EO)Linker, and Table 9 provides surface tension data of EXXAL™ 11-Galactose-3(EO)Linker.

TABLE 7

Compound 1
n-undecanol-glucose-3(EO)Linker
Surface Tension Data

| Molarity [mol/L] | Surface Tension (γ) [mN/m] |
|---|---|
| 0 | 72.1 |
| 8.42635E−07 | 70.2 |
| 2.29052E−06 | 66.4 |
| 6.22628E−06 | 61.5 |
| 1.69248E−05 | 55.6 |
| 4.60064E−05 | 48.6 |
| 0.000125058 | 41.0 |
| 0.000339945 | 34.5 |
| 0.000924077 | 33.2 |
| 0.001928806 | 33.1 |

TABLE 8

Compound 2
EXXAL ™ 11-Glucose-3(EO)Linker
Surface Tension Data

| Molarity [mol/L] | Surface Tension (γ) [mN/m] |
|---|---|
| 0 | 72.0 |
| 8.42635E−07 | 70.5 |
| 2.29052E−06 | 67.7 |
| 6.22628E−06 | 63.6 |
| 1.69248E−05 | 58.3 |
| 4.60064E−05 | 51.8 |
| 0.000125058 | 44.6 |
| 0.000339945 | 33.0 |
| 0.000924077 | 30.6 |
| 0.002678897 | 30.2 |

TABLE 9

Compound 3
EXXAL ™ 11-Galactose-3(EO)Linker
Surface Tension Data

| Molarity [mol/L] | Surface Tension (γ) [mN/m] |
|---|---|
| 0 | 72.0 |
| 8.42635E−07 | 71.0 |
| 2.29052E−06 | 68.8 |
| 6.22628E−06 | 64.6 |

TABLE 9-continued

| Compound 3 EXXAL ™ 11-Galactose-3(EO)Linker Surface Tension Data | |
|---|---|
| Molarity [mol/L] | Surface Tension (γ) [mN/m] |
| 1.69248E−05 | 59.2 |
| 4.60064E−05 | 53.2 |
| 0.000125058 | 46.5 |
| 0.000339945 | 39.3 |
| 0.000924077 | 32.7 |
| 0.001800219 | 31.0 |

With particular respect to FIG. 1, a surface tension isotherm is shown for EXXAL™ 11-EO3-Glucoside, functionalized branched alcohols. With particular respect to FIG. 2, surface tension isotherms are shown for EXXAL™ 11-EO3-Glucoside (functionalized branched alcohols) and for Undecanol-EO3-Glucoside, which is a comparative glucose-modified linear C11 alcohol ethoxylate. Both compounds show high efficiency and substantial surface tension reduction.

Figure 2:
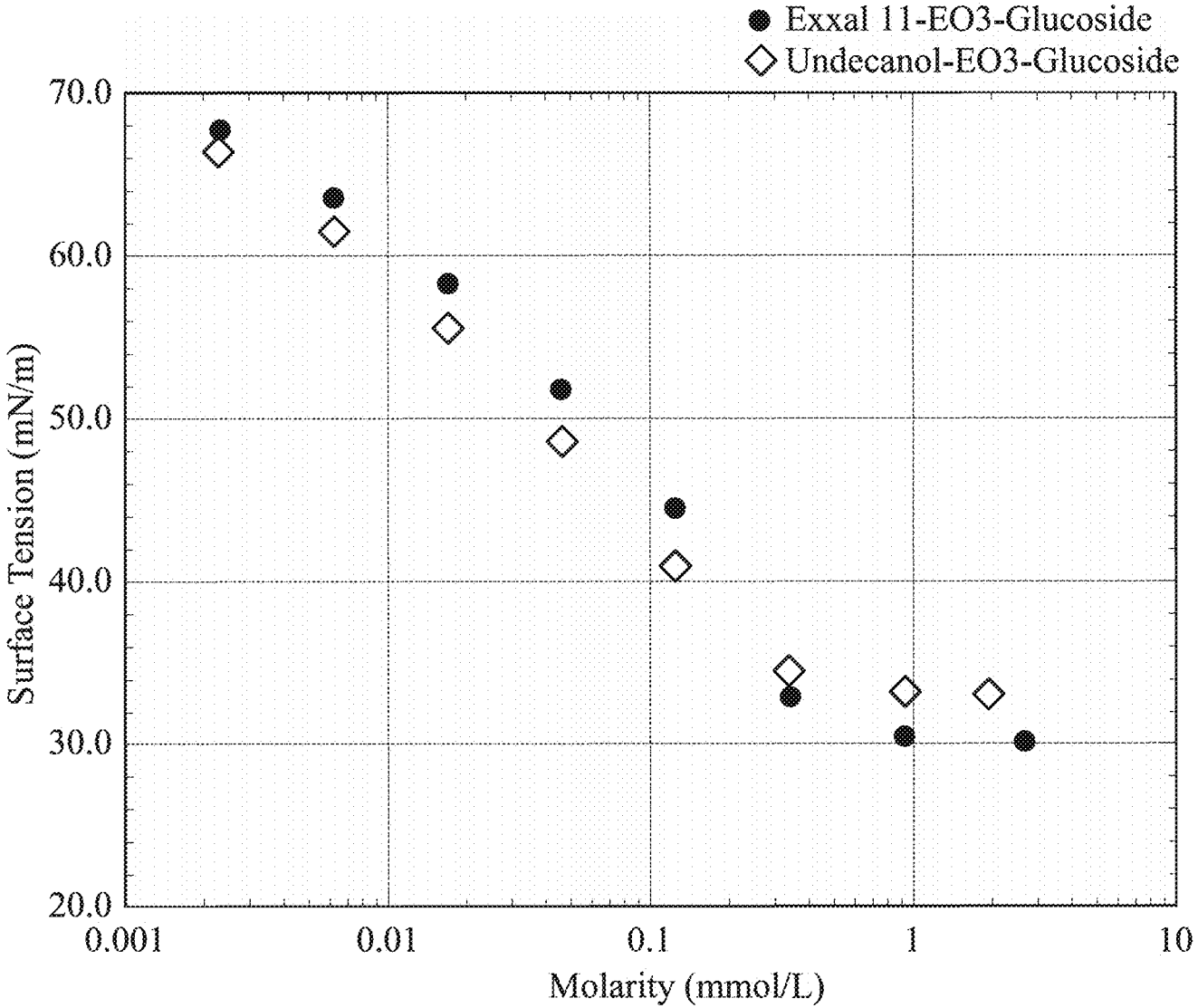
FIG. 2 is a surface tension isotherm of EXXAL™ 11-EO3-Glucoside and a comparative surface tension isotherm of a mono-component linear C11 surfactant with the same ethoxylation and glucose functionalization (Undecanol-EO3-Glucoside).

Measured surface tension isotherm data, shown in FIG. 2, demonstrate that the new compound, the ethoxylated EXXAL™ 11 with terminal glucose functionalization (EXXAL™ 11-EO3-Glucoside), is a highly effective and efficient surfactant molecule. The isomeric and molecular weight distribution in the hydrophobic branched alcohol segment has no adverse effects and is comparable to a mono-component model system (Undecanol-EO3-Glucoside having a linear undecanol with the same degree of ethoxylation and glucose functionalization). In fact, the EXXAL-based surfactant EXXAL™ 11-E03-Glucoside is more effective, i.e., its minimum surface tension is 10% lower compared to the model system of Undecanol-EO3-Glucoside. Attaching glucose to moderately ethoxylated alcohol mixtures has the advantage of being more biodegradable when compared to conventional ethoxylated alcohols, and does not require any solubilizers to maintain its water solubility.

The surface tension isotherm data of FIG. 2 and Table 8 show the CMC of EXXAL™ 11-EO3-Glucoside to be between about 1 mmol/L and about 3 mmol/L. EXXAL™ 11-EO3-Glucoside has a molecular weight of 466.61 g/mol; the CMC is equivalent to a concentration between about 0.47 g/L and about 1.40 g/L. Accordingly, it is expected that surfactants would comprise the present functionalized branched alcohols and functionalized extended branched alcohols at a concentration between about 0.47 g/L and about 1.40 g/L.

Figure 3A:
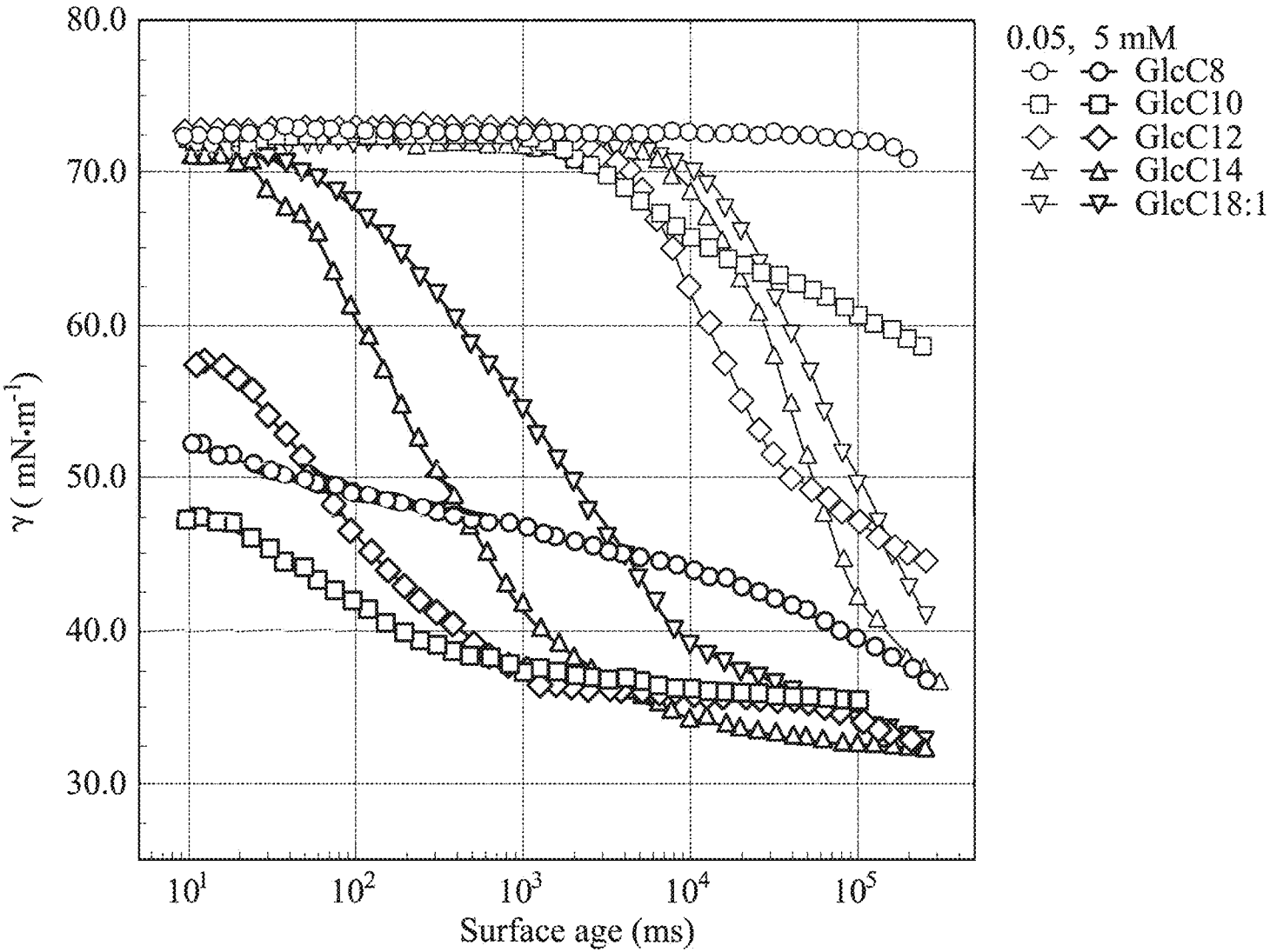
FIG. 3A, FIG. 3B and FIG. 3C provide maximum bubble pressure surface tension data for mono-component alkyl-TEG-glucoside surfactants described in Moore, J. E., et.al. Journal of Colloid and Interface Science 529 (2018) 464-475 at 467 & 468, incorporated herein by reference. Specifically.
Figure 3B:
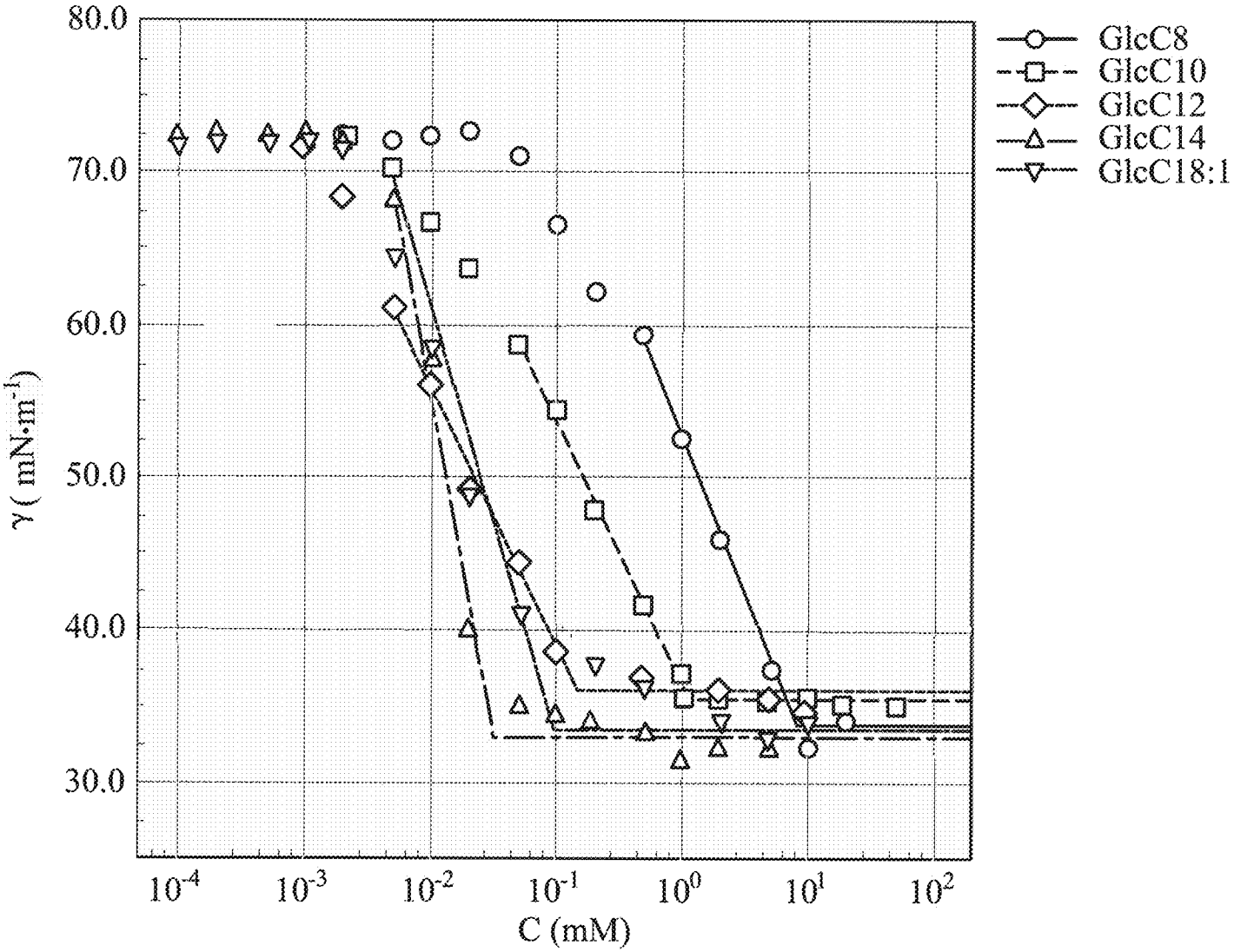
Figure 3C:
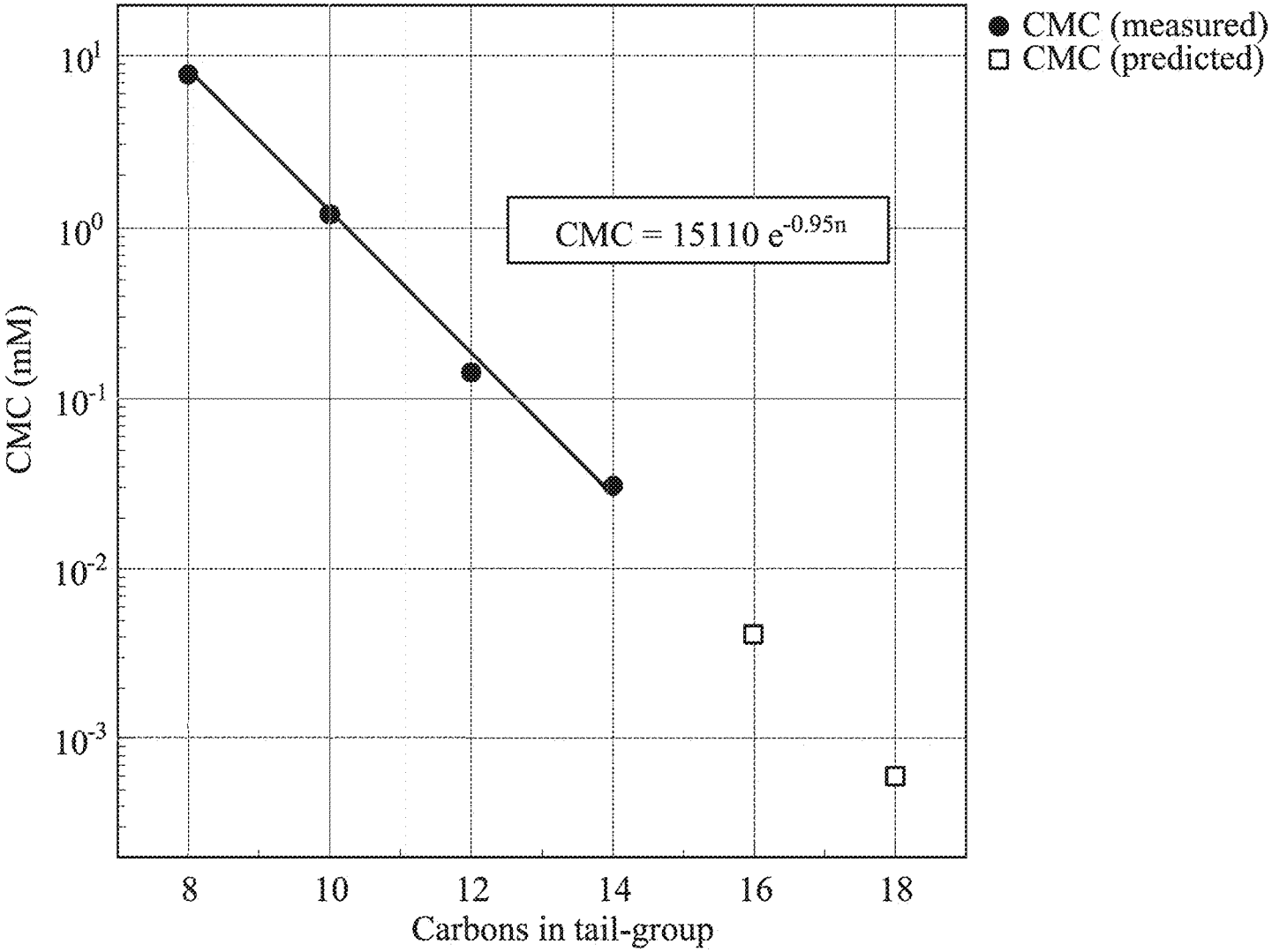

FIG. 3A, FIG. 3B and FIG. 3C provide maximum bubble pressure surface tension data for alkyl-TEG-glucoside surfactants described in Moore, J.E., et.al. Journal of Colloid and Interface Science 529 (2018) 464-475 at 467 & 468, incorporated herein by reference. The figures provide only GlcC10, GlcC12, and other even-numbered carbon tails. However, a surfactant having a tail with 11 carbons (GlcC11) would be expected to produce a surface tension isotherm falling between that of GlcC10 and GlcC12. Furthermore, the n-undecanol-glucose-3(EO)Linker of the present example has structure equivalent to a GlcC11 surfactant.

Biodegradability data for EXXAL™ 11-EO3-Glucoside and the control, sodium benzoate was obtained according to OECD 301F manometric respirometry test guidelines at test material concentrations of 57 to 100 mg/L. Results are provided in Tables 10A and 10 B.

TABLE 10A

| Percent Biodegradation (%) EXXAL ™ 11-EO3-Glucoside ($C_{23}H_{46}O_9$) | | | | |
|---|---|---|---|---|
| Day | Rep 1 | Rep 2 | Mean | SD |
| 1 | 0.00 | 0.08 | 0.04 | 0.06 |
| 2 | 3.76 | 4.21 | 3.99 | 0.32 |
| 3 | 6.68 | 6.25 | 6.47 | 0.30 |
| 4 | 10.74 | 10.85 | 10.80 | 0.08 |
| 5 | 13.70 | 15.07 | 14.39 | 0.97 |
| 6 | 17.81 | 20.74 | 19.28 | 2.07 |
| 7 | 22.62 | 25.61 | 24.12 | 2.11 |
| 8 | 27.69 | 30.66 | 29.18 | 2.10 |
| 9 | 32.92 | 35.43 | 34.18 | 1.77 |
| 10 | 37.15 | 39.57 | 38.36 | 1.71 |
| 11 | 41.14 | 44.12 | 42.63 | 2.11 |
| 12 | 44.12 | 48.10 | 46.11 | 2.81 |
| 13 | 46.68 | 52.38 | 49.53 | 4.03 |
| 14 | 49.74 | 58.01 | 53.88 | 5.85 |
| 15 | 53.33 | 64.80 | 59.07 | 8.11 |
| 16 | 56.32 | 71.18 | 63.75 | 10.51 |
| 17 | 59.30 | 74.47 | 66.89 | 10.73 |
| 18 | 63.65 | 76.72 | 70.19 | 9.24 |
| 19 | 66.77 | 78.14 | 72.46 | 8.04 |
| 20 | 68.97 | 79.19 | 74.08 | 7.23 |
| 21 | 70.72 | 80.30 | 75.51 | 6.77 |
| 22 | 73.01 | 81.52 | 77.27 | 6.02 |
| 23 | 74.24 | 82.32 | 78.28 | 5.71 |
| 24 | 75.55 | 83.14 | 79.35 | 5.37 |
| 25 | 77.35 | 84.41 | 80.88 | 4.99 |
| 26 | 79.10 | 85.83 | 82.47 | 4.76 |
| 27 | 79.78 | 86.47 | 83.13 | 4.73 |
| 28 | 80.35 | 87.09 | 83.72 | 4.77 |

TABLE 10B

| Percent Biodegradation (%) Control (Sodium Benzoate) | | | | | |
|---|---|---|---|---|---|
| Day | Rep 1 | Rep 2 | Rep 3 | Mean | SD |
| 1 | 22.43 | 21.14 | 23.95 | 22.51 | 1.41 |
| 2 | 58.41 | 57.65 | 57.88 | 57.98 | 0.39 |
| 3 | 61.48 | 60.26 | 61.12 | 60.95 | 0.63 |
| 4 | 71.33 | 69.35 | 71.00 | 70.56 | 1.06 |
| 5 | 79.98 | 75.69 | 74.96 | 76.88 | 2.71 |
| 6 | 82.92 | 81.01 | 78.75 | 80.89 | 2.09 |
| 7 | 85.65 | 84.56 | 83.60 | 84.60 | 1.03 |
| 8 | 88.21 | 86.83 | 86.30 | 87.11 | 0.99 |
| 9 | 90.06 | 88.89 | 88.29 | 89.08 | 0.90 |
| 10 | 90.68 | 90.11 | 90.06 | 90.28 | 0.34 |
| 11 | 91.37 | 90.72 | 90.99 | 91.03 | 0.33 |
| 12 | 91.92 | 91.23 | 91.59 | 91.58 | 0.35 |
| 13 | 92.38 | 91.66 | 92.07 | 92.04 | 0.36 |
| 14 | 92.85 | 92.11 | 92.56 | 92.51 | 0.37 |
| 15 | 93.24 | 92.48 | 93.03 | 92.92 | 0.39 |
| 16 | 93.52 | 92.69 | 93.28 | 93.16 | 0.43 |
| 17 | 93.70 | 92.93 | 93.60 | 93.41 | 0.42 |
| 18 | 94.11 | 93.32 | 94.01 | 93.81 | 0.43 |
| 19 | 94.45 | 93.59 | 94.33 | 94.12 | 0.47 |
| 20 | 94.67 | 93.79 | 94.53 | 94.33 | 0.47 |
| 21 | 94.86 | 93.98 | 94.86 | 94.57 | 0.51 |
| 22 | 95.13 | 94.10 | 94.94 | 94.72 | 0.55 |
| 23 | 95.28 | 94.30 | 95.16 | 94.91 | 0.53 |
| 24 | 95.44 | 94.30 | 95.21 | 94.98 | 0.60 |
| 25 | 95.57 | 94.36 | 95.33 | 95.09 | 0.64 |
| 26 | 95.76 | 94.50 | 95.50 | 95.25 | 0.67 |
| 27 | 95.89 | 94.58 | 95.58 | 95.35 | 0.68 |
| 28 | 95.91 | 94.59 | 95.57 | 95.36 | 0.69 |

Figure 6:
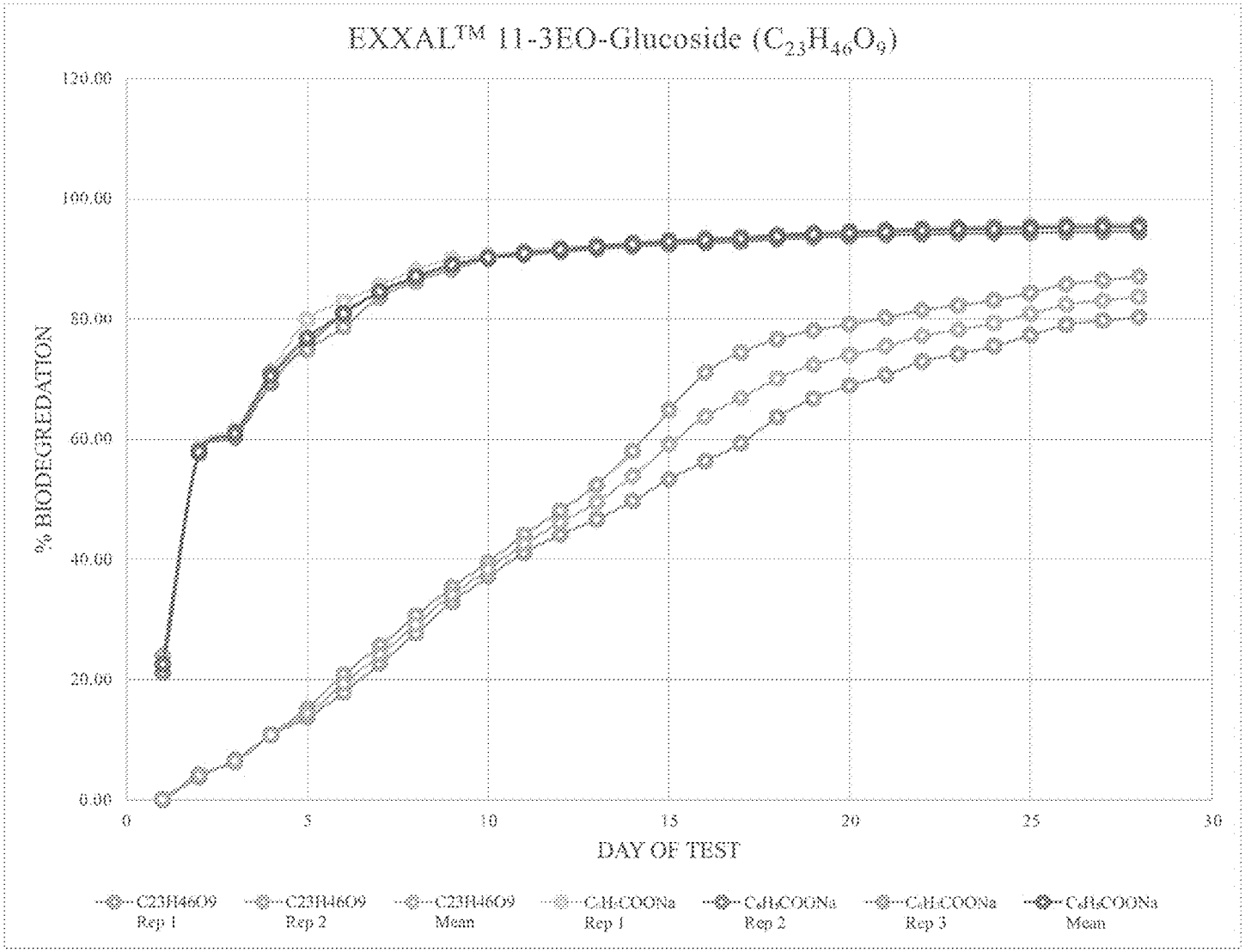
FIG. 6 depicts biodegradation over time for each of EXXAL™ 11-EO3-Glucose and the control, sodium benzoate

Also, the data of Tables 10A and 10B is present in FIG. 6. Comparatively, EXXAL™ 11-EO3-Glucoside has a biodegradability at Day 28 as good or better than many other compounds as shown in Table 11 immediately below.

TABLE 11

Biodegradability of Several Compounds at Day 28

| Substance | Day 28 (% Biodegradability |
|---|---|
| EXXAL ™ 11 | 71 |
| EXXAL ™ 11-3EO | 77, 81 |
| EXXAL ™ 11-5EO | 81, 82 |
| EXXAL ™ 11-7EO | 106 |
| EXXAL ™ 11-8EO | 87 |
| EXXAL ™ 11-10EO | 95 |
| EXXAL ™ 11-EO3-Glucoside | 80, 86 |

We claim:

1. A functionalized branched alcohol comprising a glycosyl group, an ethylene oxide linker and a tail, wherein the ethylene oxide linker comprises one or more units of ethylene oxide, the glycosyl group is a substituent structure of glucose, mannose, galactose, sorbose, fructose, xylose, arabinose, ribose, lyxose, lactose, or maltose, or a variant thereof, the tail comprises 9 to 13 carbon atoms and has an average branching between 1.61 and 3.07, the glycosyl group is attached to the ethylene oxide linker and the ethylene oxide linker is attached to the tail.

2. The functionalized branched alcohol of claim 1, wherein the glycosyl group is a substituent structure of glucose.

3. The functionalized branched alcohol of claim 1, wherein the number of units of ethylene oxide is 3.

4. A compound of the structural formula:

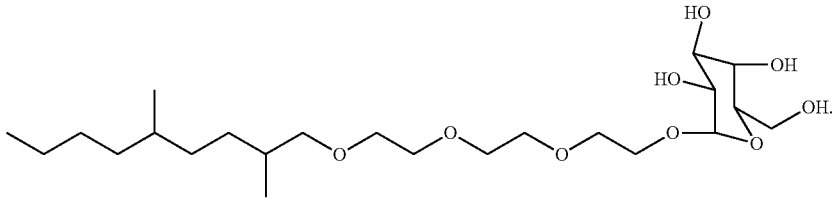

5. A mixture of functionalized branched alcohols comprising a plurality of compounds, each compound of the plurality of compounds having a structural formula:

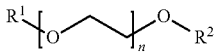

wherein n is an integer from 1 to 7;

$R^1$ is a branched paraffin and isomers thereof having an average branching between 1.61 and 3.07;

$R^2$ is a glycosyl group; and the amount of the plurality of compounds is at least 70 wt. %.

6. The mixture of claim 5, wherein the mixture further comprises isomers of one or more of the plurality of compounds.

7. The mixture of claim 5, wherein the mixture has a carbon distribution number between about 10 and about 13.

8. The mixture of claim 5, wherein the glycosyl group is a substituent structure of glucose, mannose, galactose, sorbose, fructose, xylose, arabinose, ribose, lyxose, lactose, or maltose, or variants thereof.

9. The mixture of claim 5, wherein the glycosyl group is a substituent structure of glucose.

10. The mixture of claim 5, wherein the compound demonstrates at least 60% degradation in 28 days as measured in accordance with OECD 301 F.

11. The functionalized branched alcohols of claim 1, wherein the functionalized branched alcohols are soluble in water without addition of solubilizers.

12. A non-ionic surfactant comprising the functionalized branched alcohols of claim 1.

* * * * *